US006896356B1

(12) United States Patent
Otsuka et al.

(10) Patent No.: US 6,896,356 B1
(45) Date of Patent: May 24, 2005

(54) PRINT APPARATUS AND PRINTING METHOD FOR FORMING A COLOR IMAGE BY APPLYING DIFFERENT COLOR INKS TO A PRINTING MATERIAL USING A RECORDING HEAD

(75) Inventors: Naoji Otsuka, Yokohama (JP); Kiichiro Takahashi, Kawasaki (JP); Hitoshi Nishikori, Inagi (JP); Osamu Iwasaki, Tokyo (JP); Toshiyuki Chikuma, Kawaski (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 09/675,005

(22) Filed: Sep. 29, 2000

(30) Foreign Application Priority Data

Sep. 30, 1999 (JP) ..... 11/278952

(51) Int. Cl.[7] ..... B41J 2/21
(52) U.S. Cl. ..... 347/43; 347/15; 347/41
(58) Field of Search ..... 347/43, 15, 41, 347/16

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,528,576 A | | 7/1985 | Koumura et al. | 347/43 |
| 4,558,333 A | | 12/1985 | Sugitani et al. | 346/140 |
| 4,593,295 A | | 6/1986 | Matsufuji et al. | 347/43 |
| 4,723,129 A | | 2/1988 | Endo et al. | 346/1.1 |
| 4,740,796 A | | 4/1988 | Endo et al. | 346/1.1 |
| 5,225,849 A | | 7/1993 | Suzuki et al. | 347/43 |
| 5,754,198 A | | 5/1998 | Nishikawa | 347/43 |
| 6,273,550 B1 | * | 8/2001 | Brown | 347/43 |
| 6,302,508 B1 | * | 10/2001 | Asauchi et al. | 347/15 |
| 6,382,765 B1 | * | 5/2002 | Kanda et al. | 347/23 |

FOREIGN PATENT DOCUMENTS

| | | |
|---|---|---|
| EP | 0300743 | 1/1989 |
| EP | 0863479 | 9/1998 |
| EP | 0911174 | 4/1999 |
| EP | 1072421 | 1/2001 |
| JP | 79-56847 | 5/1979 |
| JP | 59-123670 | 7/1984 |
| JP | 84-138461 | 8/1984 |
| JP | 85-71260 | 4/1985 |

* cited by examiner

*Primary Examiner*—Lamson Nguyen
(74) *Attorney, Agent, or Firm*—Fitzpatrick, Cella Harper & Scinto

(57) ABSTRACT

A printing apparatus for forming a color image by applying different color inks to a printing material while bi-directionally moving the recording head to scan the cording material, the apparatus includes changing device for changing an order of applications of the inks to be applied for printing a secondary color to a secondary color pixel area; forming device for forming the secondary color while making the order of applications of the inks to at least one of a plurality of the secondary color pixel areas arranged along a raster scan direction different from the order of another, by the changing device.

27 Claims, 28 Drawing Sheets

PRINT APPARATUS AND PRINTING METHOD FOR FORMING A COLOR IMAGE BY APPLYING DIFFERENT COLOR INKS TO A PRINTING MATERIAL USING A RECORDING HEAD

FIELD OF THE INVENTION AND RELATED ART

The present invention relates to a bi-directional printing apparatus and a bi-directional printing method for effecting color print by scanning bi-directionally a printing material with a recording head for applying a plurality of (different) color inks to the printing material, and more particularly to a bi-directional printing apparatus, a bi-directional printing method and a print wherein color non-uniformity attributable to bi-directional color print operation.

In the field of a printing apparatus, particularly an ink jet type printing apparatus, increase of a recording speed for color print is desired. To meet this desire, increase of the length of the recording head, increase of the frequency of actuation of the recording head, bi-directional printing are generally considered. The bi-directional printing is advantageous in that required energy is less concentrated than a unidirectional printing and is scattered in terms of time under the same throughput, and therefore, it is advantageous in the cost as a total system.

However, the bi-directional printing type is disadvantageous in that it involves an essential problem that order of deposition or application or shot of the inks of different colors are different between the forward direction of the main-scanning and the backward direction thereof, depending on the structure of the recording head, and therefore, color non-uniformity in the form of bands results. The problem arises from the order of the ink applications, and therefore, a difference in the coloring more or less appears when different color dots are overlaid with each other even slightly.

When an image is formed by electing coloring materials such as pigment or dye ink onto a printing material, the ink first applied first dyes the printing material from the surface layer to the inside of the printing material. When a subsequent dot ink is applied in the manner that it at least partly overlaps with the prior ink dot, the subsequent ink dyes more at a portion below the already dyed portion, and therefore, there is a tendency that resultant color has a first-color-rich nature. On the other hand, in the case that ejection nozzles for different colors are arranged in the main scan direction, the order of ink shots in the forward scanning operation is opposite from the order of the ink shots in the backward scanning operation. Therefore, the band color non-uniformity occurs due to the difference in the coloring.

The phenomenon occurs similarly in the case of wax type coloring material when a process color is formed due to the time difference, although the printing principles are different.

In the in ink jet printer supporting the print, the problem is avoided using the following methods.

1) accept the color non-uniformity. Or, only black (Bk) is printed bi-directionally.

2) the nozzles for different colors are arranged in the sub-scan direction (so-called vertical arrangement).

3) the use is made with nozzles for forward path and nozzles for backward path, and the different nozzles or heads are used in the forward path and the backward path so that order of shots are the same.

4) the printing is effected such that rasters to be printed during the forward path and the backward path are interlaced, by which the frequency of the color non-uniformity due to the difference in the order of the shots is increased to provide visual uniformity.

SUMMARY OF THE INVENTION

However, the conventional technique 1) does not provide a fundamental solution, and the throughput is significantly lower when a color image is printed.

2) the shot orders are the same in the forward path and the backward path, but the length of the recording head is large, and another difference in the coloring occurs due to the time difference in the shots of different colors.

3) this is equivalent to use independent two sets of recording heads even if the recording heads for the forward path and the backward path are built in the same substrate, and therefore, a color non-uniformity due to large color difference in the form of bands attributable to the difference of the properties of different heads. For example, due to the difference in the data ratio of the forward path data to the backward path data, the temperature of the recording head may be different, there arises a difference in the ejection amounts between the recording heads, which would result in the color non-uniformity in the form of bands.

This is a significant problem in a single-path bi-directional printing. But, the same problem arises in the bi-directional multi-path printing, depending upon the difference in the number of dots to be recorded in the forward path and the number thereof in the backward path, the difference in the number of dots resulting from a thinning mask for supplying the data, or the difference in the number of dots to be print with synchronism with the printing raster.

4) this provide regularly high frequency color non-uniformity to visually hide the color non-uniformity, but the color difference may be stressed by interference, depending on the print data. For example, when the color difference is produced for each raster line, a large color difference results even if the same color is instructed, when there are a portion where the incidence is high on the even number rasters and a portion where the incidence is high on the odd number rasters in the forward path and the backward path due to half-tone process such as shading or the like.

Accordingly, it is a principal object of the present invention to provide a printing apparatus, a printing method and a print wherein the color non-uniformity attributable to the scanning directions can be reduced even if a bi-directional color print is carried out.

It is another object of the present invention to provide a printing apparatus, a printing method and a print wherein the occurrence of the color non-uniformity attributable to the scanning direction irrespective of the print data.

It is a further object of the present invention to provide a printing apparatus, a printing method and print wherein the occurrence of the color non-uniformity attributable to the scanning direction can be reduced in a low density portion and a high density portion.

According to an aspect of the present invention, there is provided a printing apparatus for forming a color image by applying different color inks to a printing material while bi-directionally moving the recording head to scan the recording material, said apparatus comprising changing means for changing an order of applications of the inks to be applied for printing a secondary color to a secondary color pixel area; forming means for forming the secondary color while making the order of applications of the inks to at least one of a plurality of the secondary color pixel areas arranged along a raster scan direction different from the order of another, by said changing means.

According to another aspect of the present invention, there is provided a printing apparatus for forming a color image by application of different color inks onto a printing material while bi-directionally moving the recording head to scan the printing material, said recording head having one or more sets of recording elements arranged in a scanning direction symmetrically, said apparatus comprising print buffers each corresponding to the symmetrically arranged recording elements constituting the set; and distributing means for distributing print data for a color to at least one of the print buffers on the basis of an image signal corresponding to the color image.

According to a further aspect of the present invention, there is provided a printing apparatus for forming a color image by application of different color inks to a printing material while bi-directionally moving the recording head to scan the recording material, said apparatus comprising changing means for changing an order of applications of inks of different colors to formation a process color in a process color pixel area; forming means for forming the process color by making an order of applications of the inks to at least of the secondary color pixel areas arranged in a raster one direction different from the order of another, by said changing means.

According to a further aspect of the present invention, there is provided a printing method for forming a color image by application of different color inks onto a printing material while bi-directionally moving the recording head to scan the printing material, said method comprising a first step of application of different color inks to form a secondary color in a secondary color pixel area in an order of applications; a second step of application of different color inks to form the secondary color in the secondary color pixel area in an order of applications which is different from the order in the first step.

According to a further aspect of the present invention, there is provided a print having a color image provided by different color inks, comprising a printing material; a plurality of secondary color pixel areas arranged in a predetermined direction on the printing material; wherein the plurality of pixel areas are printed by different color inks, and wherein an order of applications of the inks to at least one of the pixel areas is different from the order of another.

According to a further aspect of the present invention, there is provided a print having a color image provided by color ink of a first color and ink of a second color, comprising a printing material; a solid secondary color area thereon, said solid secondary color area including first secondary color portions and second secondary color portions appearing substantially alternately on the recording material, microscopically, wherein said first secondary color portions are provided by the inks of the first color and the second color and has the secondary color of a first-color-rich nature, and said first color portions are provided by the same different color inks and has the secondary color of a second-color-rich nature.

With such a structure, the pixel areas of a process color including a secondary color, arranged in the raster scan direction, are dominantly provided by application of the inks in different application orders, and therefore, the orders of applications are substantially the same irrespective of the scanning directions so that generation of the color non-uniformity attributable to the order of applications of the inks can be reduced.

In this specification, "print" or "recording" includes formation, on a recording material, of significant or non-significant information such as an image, a pattern, character, figure and the like, and processing of a material on the basis of such information, visualized or non-visualized manner.

Here, the "recording or printing material" includes paper used in a normal printer, textile, plastic resin material, film material, metal plate and the like which can receive ink.

Here, "ink or liquid" includes liquid usable with the "print" or "recording" defined above, and liquid usable to formation of an image, patter or the like on the printing material or to processing of the printing material.

The term "pixel area" means a minimum area where a primary color or secondary color is provided by application of one of more inks, and is not limited to a pixel but includes a super pixel or a sub-pixel. The number of scannings to complete the pixel area is not limited to one but may be plural.

The term "process color" includes secondary colors, and means a color provided by mixing three or more colors on the printing material.

According to a further aspect of the present invention, at least in the pixels where different color dots are combined, the incidence probabilities of substantially the same relation of the order of shots of at least the different colors are dominant. In a preferable embodiment of the present invention, recording elements for respective colors are arranged in the main scan direction. Using such an embodiment, it is preferable that single-path print is carried out through bi-directional print by a symmetrical recording or printing head or that bi-directional multi-path print is carried out by the symmetrical head for bi-directional print or by a known head having recording elements for respective colors arranged in the main scan direction. But, the present invention is not limited to them.

The above-described structure is effective in a half-tone area, particularly a low density portion of a color image, and for the high density portion, it is effective that for one pixel, a plurality of dots of the same color ink is allotted with respect to at least one color of the used inks and that use is made with means for making it dominant that order of the shots of the inks constituting the second or higher color for at least a secondary or higher color is symmetrical.

Here, the symmetrical recording head usable with the bi-directional print is the recording head having the recording nozzles for the respective colors arranged in a symmetrical order at least in the main scan direction as shown in FIG. 3, and the inks are applied from the nozzles to the printing material such that order of shots for each color is symmetrical for each pixel.

When a process color including a secondary color is formed in a pixel using the recording head having such a structure, a plurality of ink droplets are applied from at least one of primary color nozzle, and the nozzles are arranged symmetrically both in the forward scanning and backward scanning directions (main scan direction), by which the differences in the coloring which has conventionally caused by the synchronism with configuration data such as lateral line or the like and by the difference in the shot order at the high density portion can be avoided. Furthermore, the color non-uniformity attributable to the bi-directional print caused by synchronism with half-toning using dither method or the like in the half-tone portion and the low density portion can be suppressed by the provision of control means for providing substantially equal incidence probabilities of orders of shots between the forward path print and the backward path print for the pixels to which a combination of different color dots are allotted.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
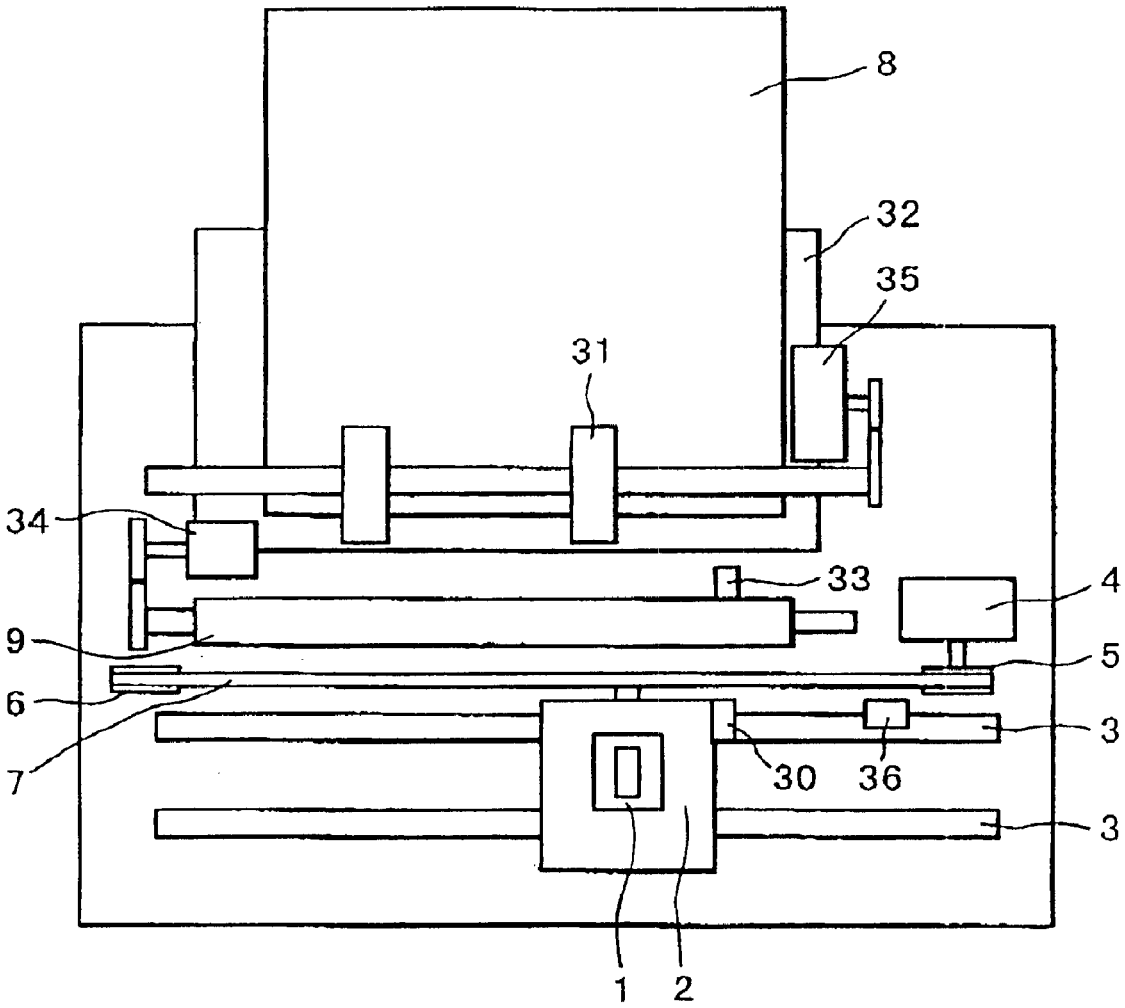
FIG. 1 shows a substantial structure of an ink jet printing apparatus according to an embodiment of the present invention.

The description will be made as to the embodiments of the present invention. In the Figures, the same reference numerals are assigned to the elements having the corresponding functions.

FIG. 1 shows a structure of a major part of an ink jet printing apparatus according to an embodiment of the present invention.

As shown in FIG. 1, a cartridge 1 is exchangeably mounted on a carriage 2. The head cartridge 1 comprises a print head portion, an ink container portion and a connector portion for receiving and supplying signals for driving the head portion (unshown).

The head cartridge 1 is carried on the carriage 2 at a correct position and is exchangeable, and the carriage 2 is provided with a connector portion and a holder (electrical connecting portion) for transmission of the driving signals or the like to the head cartridges 1 through the connector.

The carriage 2 is reciprocably supported and guided by a shaft 3 and a guide of the main assembly of the apparatus, which is extended in a main scan direction. The carriage 2 is driven through a driving mechanism such as a motor, a pulley 5, a driven pulley 6, a timing belt 7 or the like by a main-scanning motor 4, and the position and the movement are controlled A home position sensor 30 is carried on a carriage. By this, the position of the carriage 2 can be detected when the home position sensor 30 of the carriage 2 passes by the shielding plate 36.

The print mediums 8 in the form of a print sheet, thin plastic resin sheet or the like are fed out one by one from the automatic sheet feeder ("ASF") by rotating the pick-up roller 31 through a gear by a sheet feeding motor 35. By rotation of the feeding roller 9, the sheet is fed through (scanned by) a position (print portion) where the sheet is opposed to the ejection outlets of the head cartridge 1. The feeding roller 9 is rotated through the gear by rotation of the LF motor 34. At this time, the discrimination of the sheet feeding and the determination of the leading edge of the sheet is effected by the timing at which the print medium 8 passes by the paper end sensor 33. The paper end sensor 33 is also effective to detect the actual position of the trailing edge of the print medium 8 and to make the final determination of the current recording position.

The print medium 8 is supported by a platen (unshown) at its back side so as to provide a flat print surface at the print portion. The heads and cartridges 1 on the carriage 2 are supported such that ejection side surfaces thereof are faced downward in parallelism with the print medium 8 between the feeding rollers constituting a pair.

The head cartridge 1 is an ink jet head cartridge which ejects the ink using the thermal energy, and is provided with electrothermal transducers for generating thermal energy. In this example, the print head of the head cartridge 1 ejects the ink through the ejection outlet using the pressure of the bubble generated by film boiling caused by the thermal energy applied by the electrothermal transducer. Another type using a piezoelectric element to eject the ink, or the like is usable.

Figure 2:
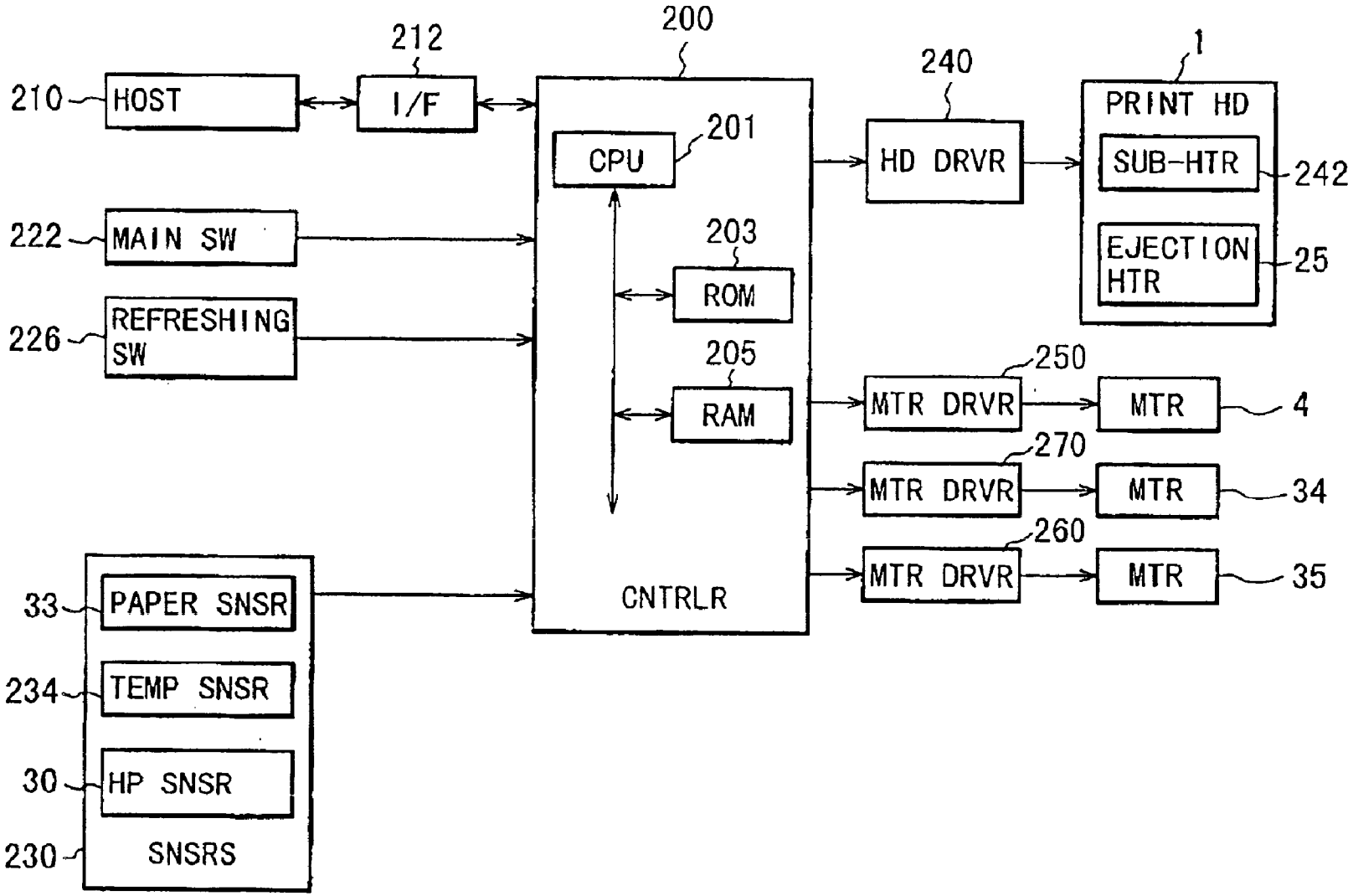
FIG. 2 is a block diagram of a control circuit for a printing apparatus.

FIG. 2 is a block diagram of a control circuit in the ink jet printing apparatus.

In these Figure, a controller 200 is a main controller, and comprises a CPU201 (a micro computer or the like), ROM203 storing a program, a table, fixed data or the like, and RAM205 having an area for conversion of image data and a wording area. The host apparatus 210 may be a supply source of image data (a computer for carrying out production and processing of data such as image to be printed, or a reader portion for reading the image to be printed, or the like). The image data, command, a status signal or the like are transmitted to and from the controller 200 through the interface (I/F) 212.

The operating portion 120 includes a group of switches for actuation by the operator, and includes a main switch 222, a recovery switch 226 for instructing the start of the suction refreshing operation.

A group of sensors includes sensors for detecting states of the apparatus, more particularly, the above-described home position sensor 30, a paper end sensor 33 for detecting presence or absence of the print medium and a temperature sensors 234 or the like disposed at proper positions for detecting the ambient temperatures.

The head driver 240 is a driver for actuating the ejection heater 25 of the print head 1 in accordance with the print data. The head driver 240 includes a shift register for aligning the print data corresponding to the positions of the ejection heater 25, a latching circuit for effecting latching at proper timing, a logic circuit element for actuating the ejection heaters in synchronism with the drive timing signal, and a timing setting portion for appropriately setting the drive timing (ejection timing) for dot formation and position alignment, or the like.

The print head 1 is provided with a sub-heater 242. The sub-heater 242 functions for temperature adjustment for stabilizing the ink ejection property, and may be formed on the print head substrate simultaneously with the formation of the ejection heater 25 or may be mounted on the head cartridge or on the main body of the print head.

The motor driver 250 functions to actuate the main-scanning motor 4, and a sub-scan motor 34 functions to feed the print medium 8 (sub-scan), and the motor driver 270 is a driver therefor.

The sheet feeding motor 34 is a motor for separating and feeding the print medium 8 from the ASF, and the motor driver 260 is a driver therefor.

(Embodiment 1)

Figure 3:
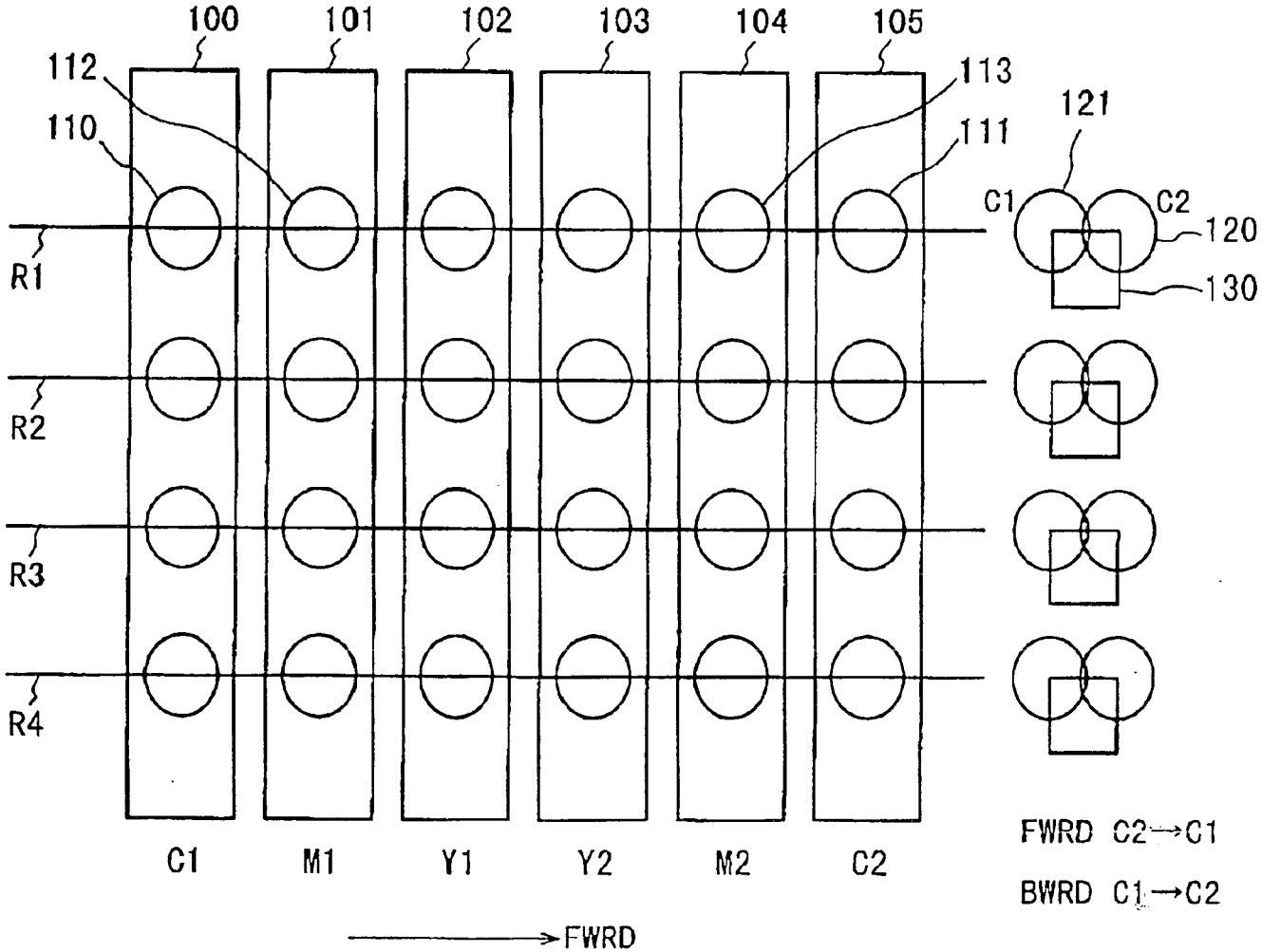
FIG. 3 shows an example of a recording head, an allotment of ejection nozzles and pixels according to an embodiment of the present invention.

FIG. 3 is a partial schematic view of a major part of a recording head portion of a head cartridge 1. In this Figure, designated by 100 is a first recording head for ejecting cyan ink (C1). Designated by 101 is a first recording head (M1) for first recording heading magenta ink (M1).

Designated by 102 is a first recording head for ejecting yellow ink (Y1). Designated by 103 is a second recording head (Y2) for ejecting yellow ink. Designated by 104 is a second recording head (M2) for ejecting magenta ink. Designated by 105 is a second recording head (M2) for ejecting cyan ink. Additionally, a recording head for ejecting Bk ink may be used, too.

The head cartridge 1 is constituted by such said recording heads.

In head cartridge 1, each of the recording heads includes a plurality of ejection nozzles. For example, the recording head 100C1 includes cyan ejection nozzles 110. The recording head 101M1 includes magenta ejection nozzles 112. The recording head 104M2 includes magenta ejection nozzles 113. The recording head 105C2 includes cyan ejection nozzles 111.

The nozzles of each of the recording heads is arranged in a direction perpendicular to the main scan direction. Strictly, they may be slightly inclined relative to the main scan direction in consideration of the ejection timing. The recording heads are arranged in the same direction as the main scan direction. More particularly, in the case of FIG. 2 example, each of the recording heads 100C1, 101M1, 102Y1, 103Y2, 104M2 and 105C2 is arranged in the same direction a the main scan direction.

The dot position 121 and the dot position 120 in this Figure, are the positions allotted for the dot provided by the ejection nozzle 110 of the recording head 100C1 and the dot provided by the ejection nozzle 111 of the recording head 105C2, both for area of the pixel (picture element) 130. In this example, the dot position 120 is located on the upper right position of the diagonal line, and the dot position 121 is located on the upper left position. Designated by R1–R4 are main-scanning line for the pixels, namely, raster lines. Here, 1 pixel is provided by 1 raster namely 1 scanning.

In the example shown in FIG. 3, the primary cyan color is printed a maximum density on the pixel. For the one pixel 130, a pair of dots are printed at the dot position 120 and the dot position 121. In this example, in a forward path in which the head cartridge 1 moves in the direction indicated by the arrow in the Figure, the order of the dots printed for the pixel 130 is C2 and then C1 provided by the recording heads 105C2 and 100C1, and in the backward path, the order is C1 and then C2. In the case of the primary color, the color of the inks are the same, so that there occurs no coloring difference depending on the difference in the order of print.

Figure 4:
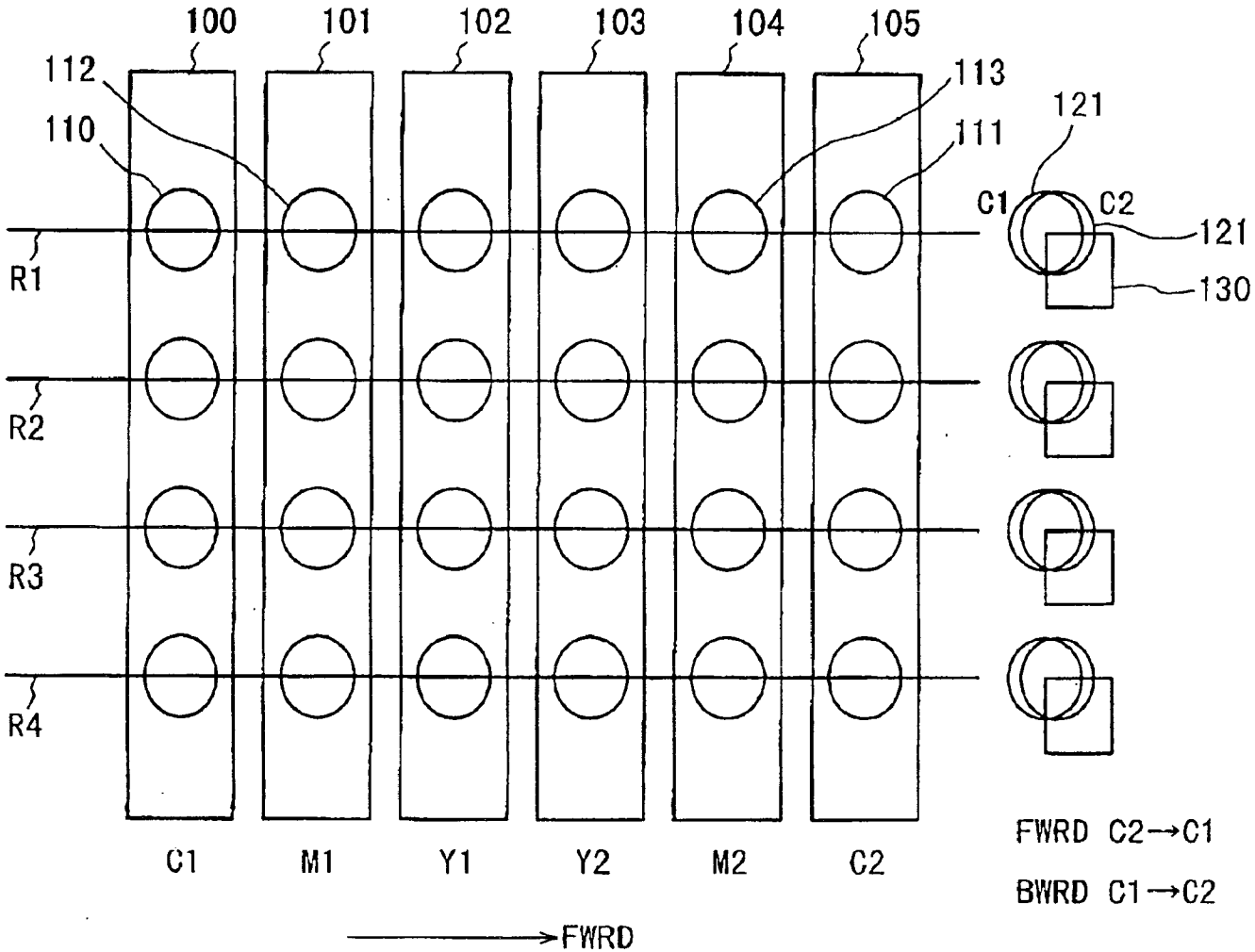
FIG. 4 shows a further example of a recording head, an allotment of ejection nozzles and a pixel.

FIG. 4 shows an example in which the pixel is printed by two dots at the dot position 121 of the pixel 130 at the maximum density using the head cartridge 1 having the same structure as FIG. 3.

What is different from FIG. 3 is that dots are overlaid (dot-on-dot, that is, the centers of gravity are substantially aligned), and therefore, the coloring of the prior dot is stronger. However, the color is the primary color in this example, and the colors are the same, there occurs no coloring difference between the forward path printing and the backward path printing.

Figure 5:
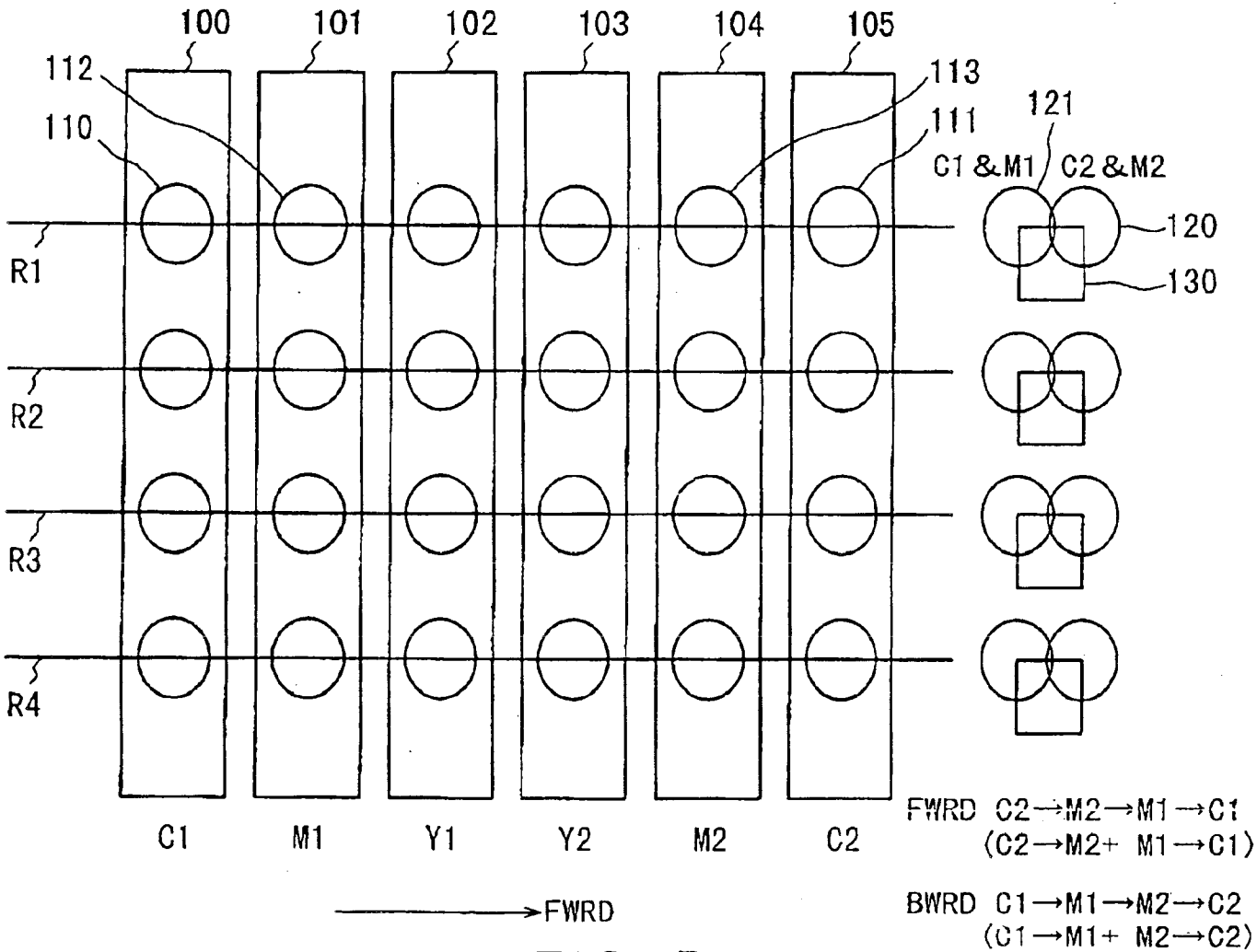
FIG. 5 shows a further example of a recording head, an allotment of ejection nozzles and a pixel.

FIG. 5 shows an example in which the use is made with the head cartridge 1 having the same structure as with FIG. 3, cyan and magenta dots are printed to the pixel 130 at the maximum density at the positions 120, 121. As is different from the pixel 130 of FIG. 3, the inks of the different colors are printed dot-on-dot in each pixel. The blue color (secondary color) is provided by cyan and magenta. The dot position 121 receives the ink from the magenta ejection nozzle 112 of the recording head 101M1 in the forward path, and then receives the ink from the cyan ejection nozzle 110 of the recording head 100C1. From the above-described principle, the color of the first ink (magenta in this case) normally tends to be dominant, that is, the color is relatively closer to the burgundy color, at the dot position 121.

Similarly, the dot position 120 receives ink from the cyan ejection nozzle 111 of the recording head 105C2 in the forward path and receives ink from the magenta ejection nozzle 113 of the recording head 104M2. From the above-described principle, the color of the first ink (magenta in this case) normally tends to be dominant, that is, the color is relatively closer to the violaceous color, at the dot position 120.

The print in the backward path will be considered. The ink from the cyan ejection nozzle 110 of the recording head 100C1 and the ink from the magenta ejection nozzle 112 of the recording head 101M1 are printed in this order. The color of the first ink (magenta in this case) normally tends to be dominant, that is, the color is relatively closer to the violaceous color, at the dot position 120. Similarly, in the backward path, the dot position 120 receives the ink from the magenta ejection nozzle 113 of the recording head 104M2, and then receives the ink from the cyan ejection nozzle 111 of the cyan. The color of the first ink (magenta in this case) normally tends to be dominant, that is, the color is relatively closer to the burgundy color, at the dot position 120.

In this manner, the blue relatively closer to burgundy (burgundy blue) and the blue relatively closer to violaceous (violaceous blue) are always appear as a pair. Microscopically, the differently colored dot columns appear alternately. When this is seen on the pixel 130 macroscopically, the order of shots (applications) of the ink is the cyan dot from C2, the magenta dot from M2, the magenta dot from the M1 and the cyan dot from C1 in the backward path, and is the cyan dot from C1, the magenta dot from M1, the magenta dot from M2, cyan dot from C2. The order is symmetrical in the pixel. Therefore, in the single pixel, the intermediary blue color can be uniformly provided.

In this invention, when the maximum density is to be provided at a pixel, it is dominant that colors constituting a secondary color for a pixel are symmetrically printed for the pixel. In this example, the blue color (cyan and magenta) is taken as the secondary color, it will be readily understood that present invention is applicable to the red (magenta and yellow) and to the green (cyan and yellow). Moreover, it will be also readily understood that in the case of a process color, that is, tertiary color, and the similar effects can be provided when the colors are symmetrically printed.

Figure 6:
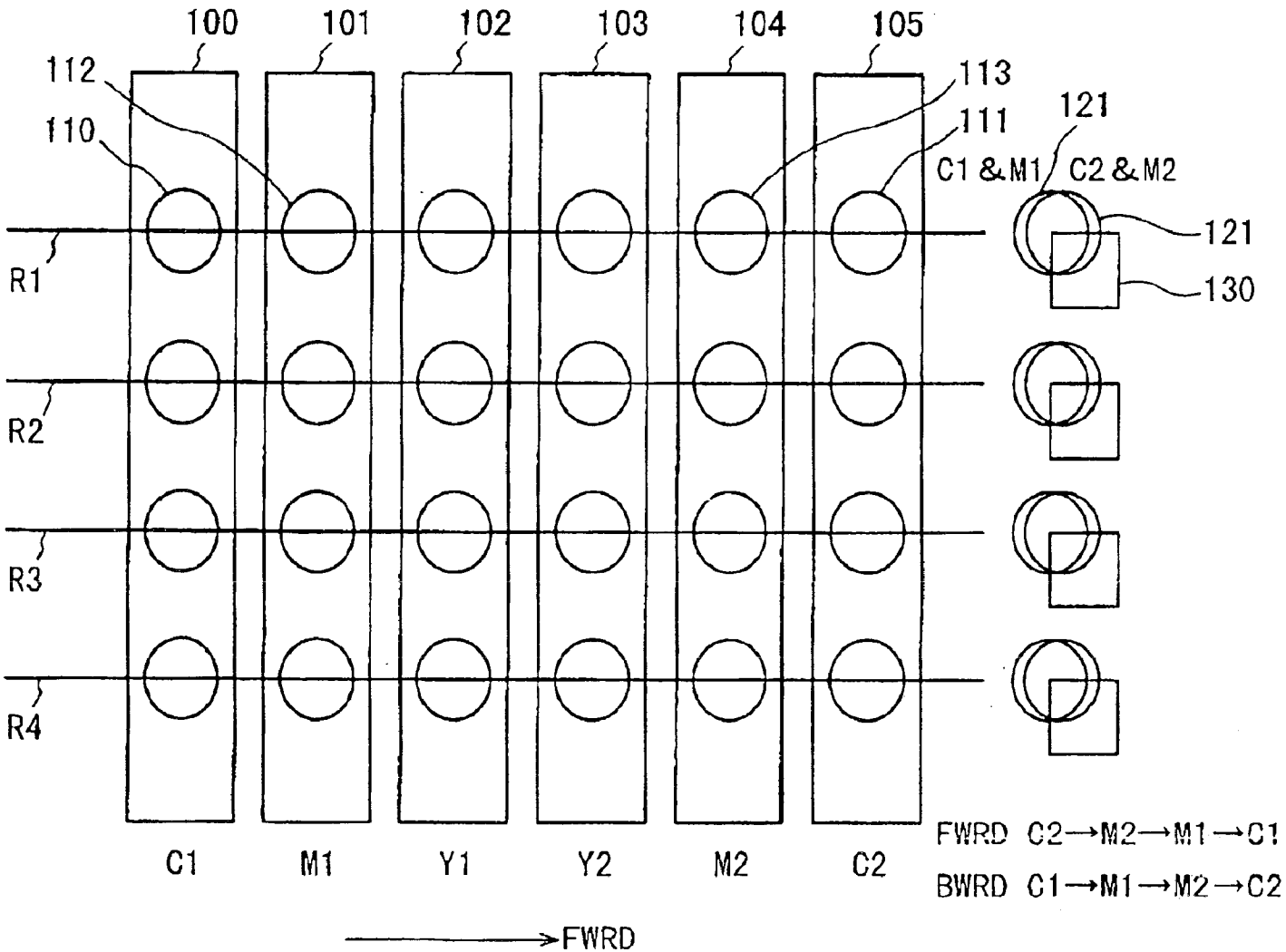
FIG. 6 shows a further example of a recording head, an allotment of ejection nozzles and a pixel.

FIG. 6 shows an example in which the use is made with the head cartridge 1 having the same structure as with FIG. 3, and the cyan and magenta dots are allotted to the dot position 121 on the pixel 130.

In this case, almost all of the different color inks are printed dot-on-dot for the pixel structures.

At the dot position 121, the order of the printing action in the forward path is such that dot from the cyan ejection nozzle 111 of the recording head 105C2, the dot from the magenta ejection nozzle 113 of the recording head 104M2, the dot from the magenta ejection nozzle 112 of the recording head 101M1, the dot from the cyan ejection nozzle 110 of the recording head 100C1 on the print medium. In the backward path, the cyan dot from C1, the magenta dot from M1, the magenta dot from M2, the cyan dot from C2 in a symmetrical pixel structure. Therefore, the blue coloring is more uniform in each pixel.

Again, when the maximum density is to be provided at a pixel, it is dominant that colors constituting a secondary color for a pixel are symmetrically printed for the pixel.

Figure 7:
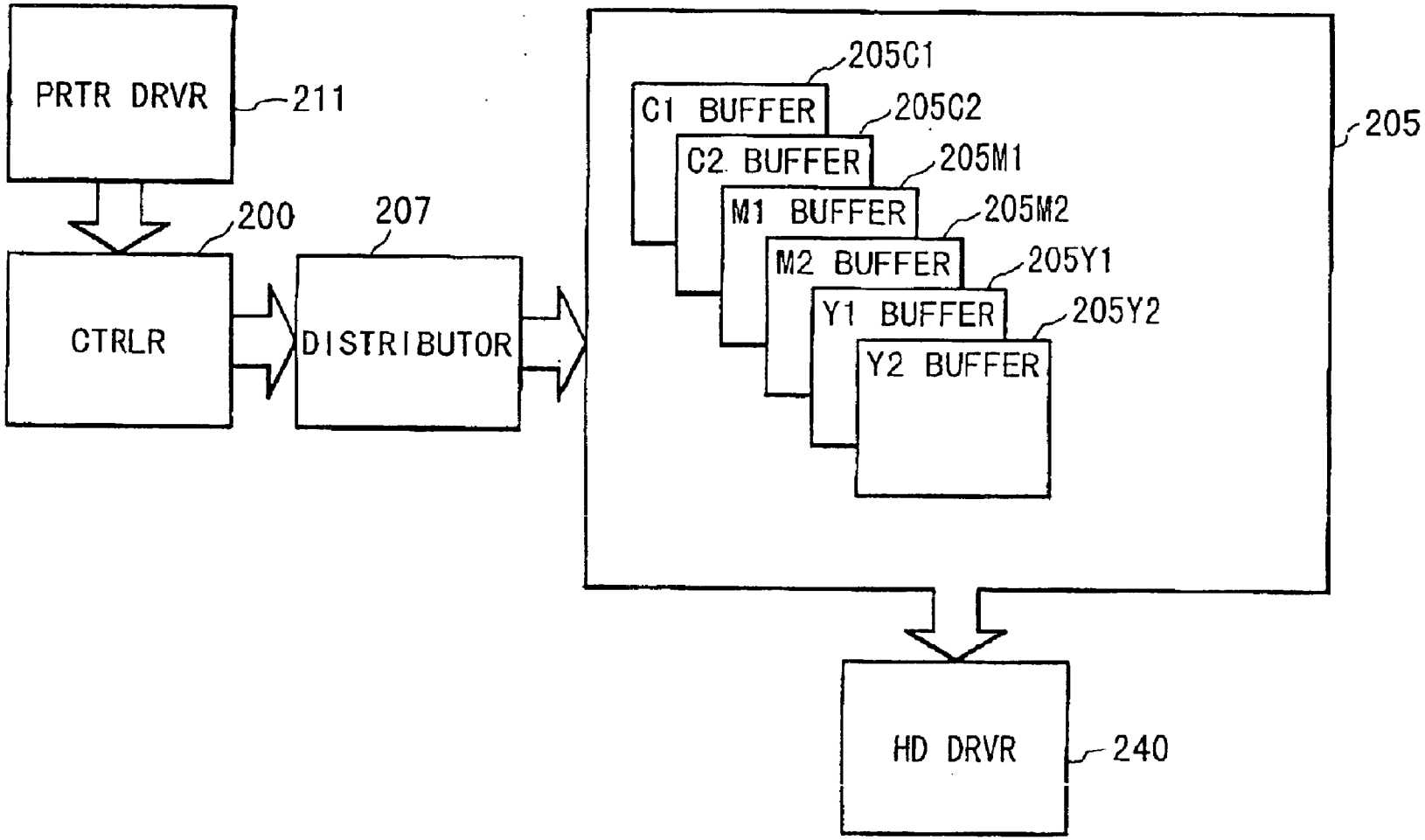
FIG. 7 is a block diagram of a buffer structure for print data according to an embodiment of the present invention.

FIG. 7 shows a data buffer structure of the printing apparatus according to this embodiment.

Figure 9:
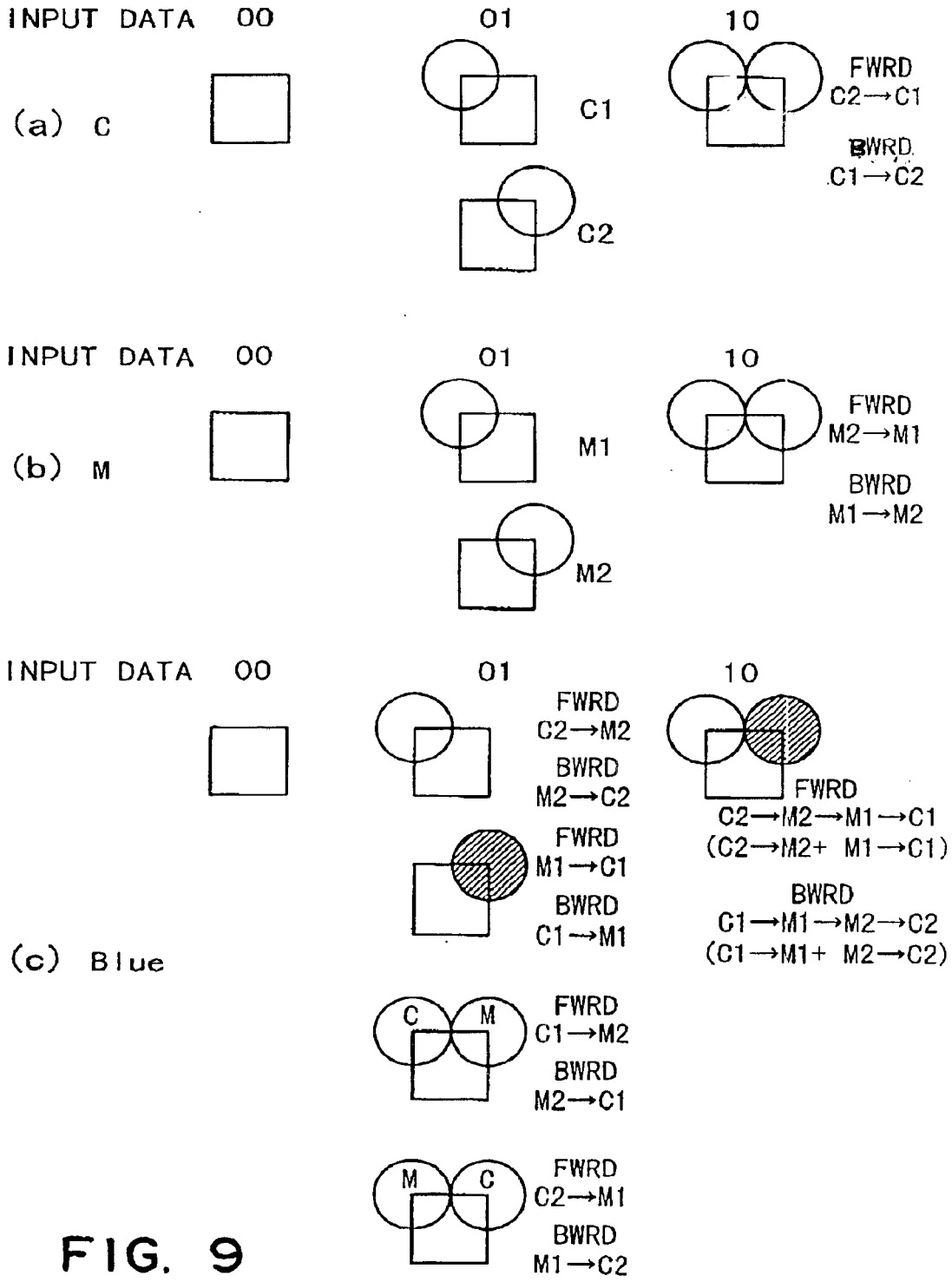
FIG. 9 shows a relation between input data and dot positions, used in Embodiment 1.

In this figure, a printer driver 211 is actuated by a program for generating image data in a host apparatus 210 and for supplying the generated data to the printing apparatus. The controller 200 converts the image data supply from the he printer driver 211 if necessary and distributes them as 2 bit data for each color (CMY). The distribution circuit 207 write the data for each of CMY colors in the print buffer 205 in accordance with a correspondence table as shown in FIG. 9 which will be described hereinafter.

For example, 2 bit data are written for the cyan color. In the type of the embodiment, when the density is the maximum, 1 bit data is written in the buffers 205C1, 205C2 for the recording heads 100C1 and 105C2, respectively. When the recording heads reach the predetermined positions for the recording for the pixels, the data in the buffer are read in the registers in the recording heads to effect the printing operations. By such data and the buffer structure, the printing can be effected on the sub-pixels from the different recording heads, for the 2 dot pairs. Here, the CMY is taken, but the same applies to the case of CMYK, to the case of light and dark inks or other colors.

The print buffers 205C1. C2, M1, M2, Y1, Y2 are provided in the RAM205.

Heretofore, the description has been made as to the case of reproducing the maximum density for each of the pixels. Now, the bi-directional print for reproducing the half-tone in a pixel will be described. Here, a specific example will be described in which multi-value data are received.

In this embodiment, three-value data (the number of dots is 0, 1 or 2) for each one component color corresponding to each color. The number of bits is not limited to 2 bit, but may be 4 bit or the like. Furthermore, even when the 2 bit data are used, only two values of them may be used. Particularly, the bit number is determined in view of the relation between the recording resolution and the dot diameter from the standpoint of the design philosophy of the degrees of the tone gradation for each pixel and the maximum density, and the present invention is usable with any of them.

When the half-tone is reproduced in a pixel, the 2-dot pair cannot be allotted in the pixel, since the 2-dot pair expresses the maximum density. In the embodiment of the present invention, in the case of the half-tone not allotting the dots in the 2-dot pair fashion, each color may contain only one dot. Therefore, when the secondary color is reproduced using the forward path and the backward path, the problem stemming from the penetration difference of coloring may arise because of the principle described in the introductory part of the specification.

In this embodiment, the control is effected such that occurrence probabilities of pixels in which the order of shots or deposition of the colors are different are substantially the same in the forward path and in the backward path, by which the coloring as seen macroscopically is the same in the forward path and the backward path. In this embodiment, the recording head is such that nozzles for each color provide a symmetrical order of shots with respect to the main scan direction to switch the order of shots in the recording scan. The order of shots can be changed in one main recording scan by dot allotment to a selected one of the recording nozzle of the two recording nozzles for the same color arranged in the main scan direction.

Figure 8:
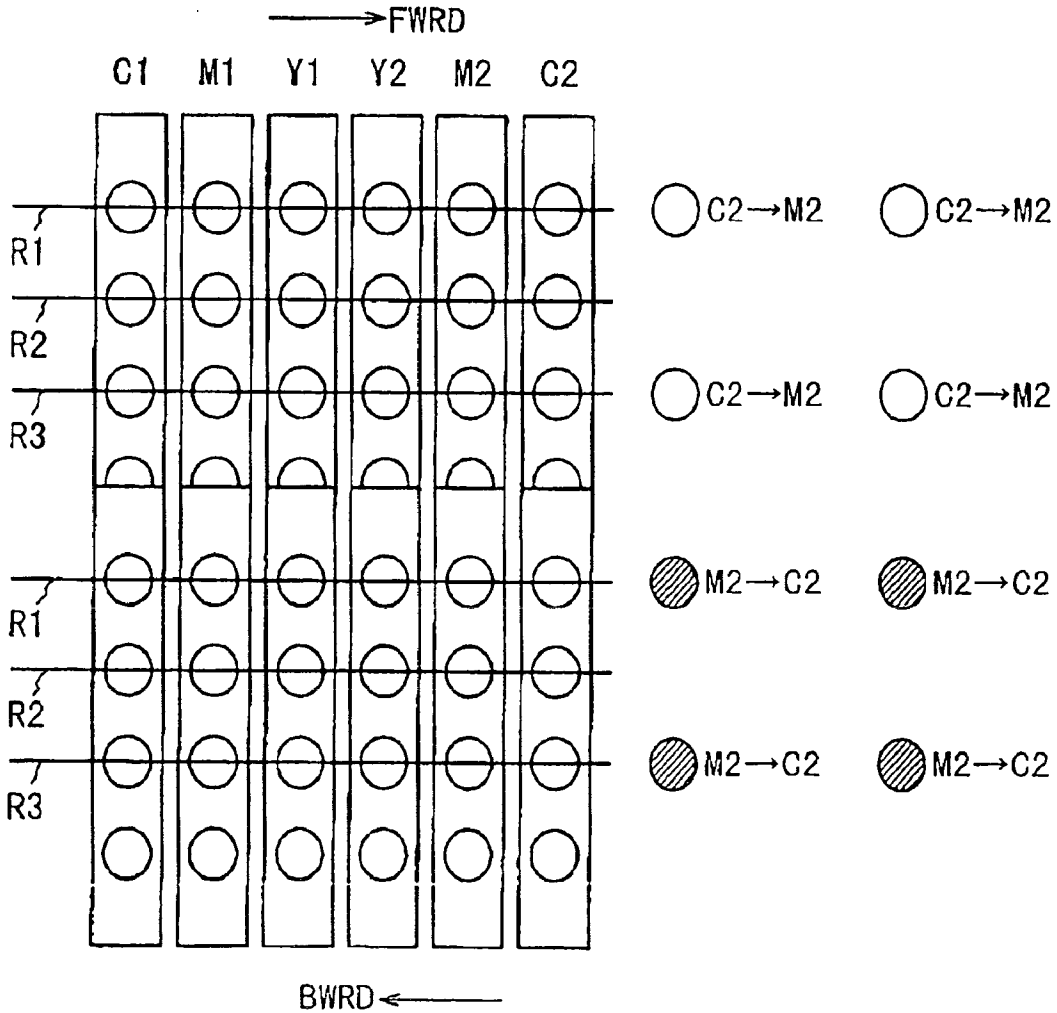
FIG. 8 shows synchronism between recording data and a forward scanning or backward scanning which occurs in a conventional example.

FIG. 8 shows a conventional example in which the used recording nozzle are synchronised by the synchronism between the recording data and the positions of the recording nozzle arrays in the bi-directional print. As will be understood from the Figure, when the blue (cyan plus magenta) is to be printed, the same orders of shots occur in the forward path printing and the backward path printing, and the color non-uniformity occurs in the form of bands extending in the scanning direction since the orders of shots are different.

Figure 10:
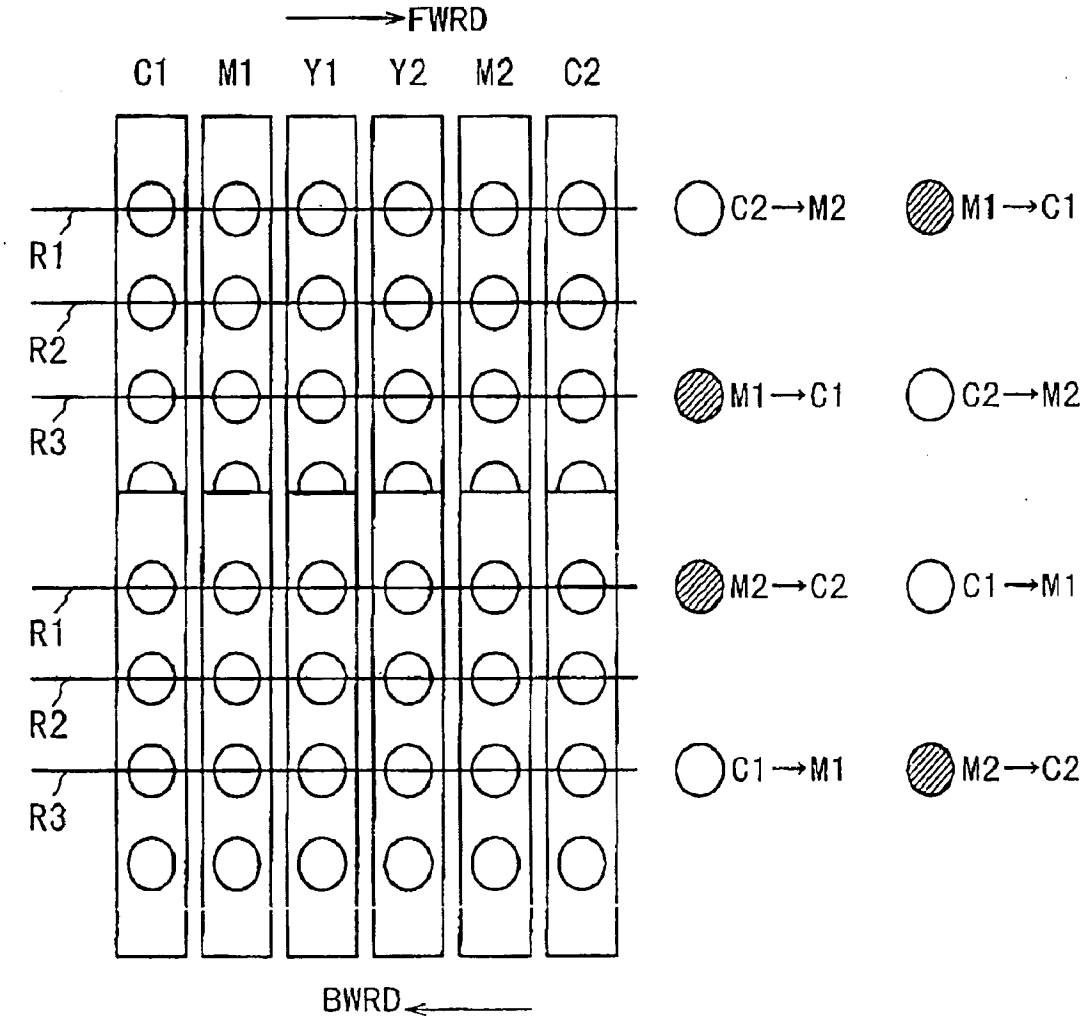
FIG. 10 shows a state in which a low density portion is printed in Embodiment 1.
Figure 11:
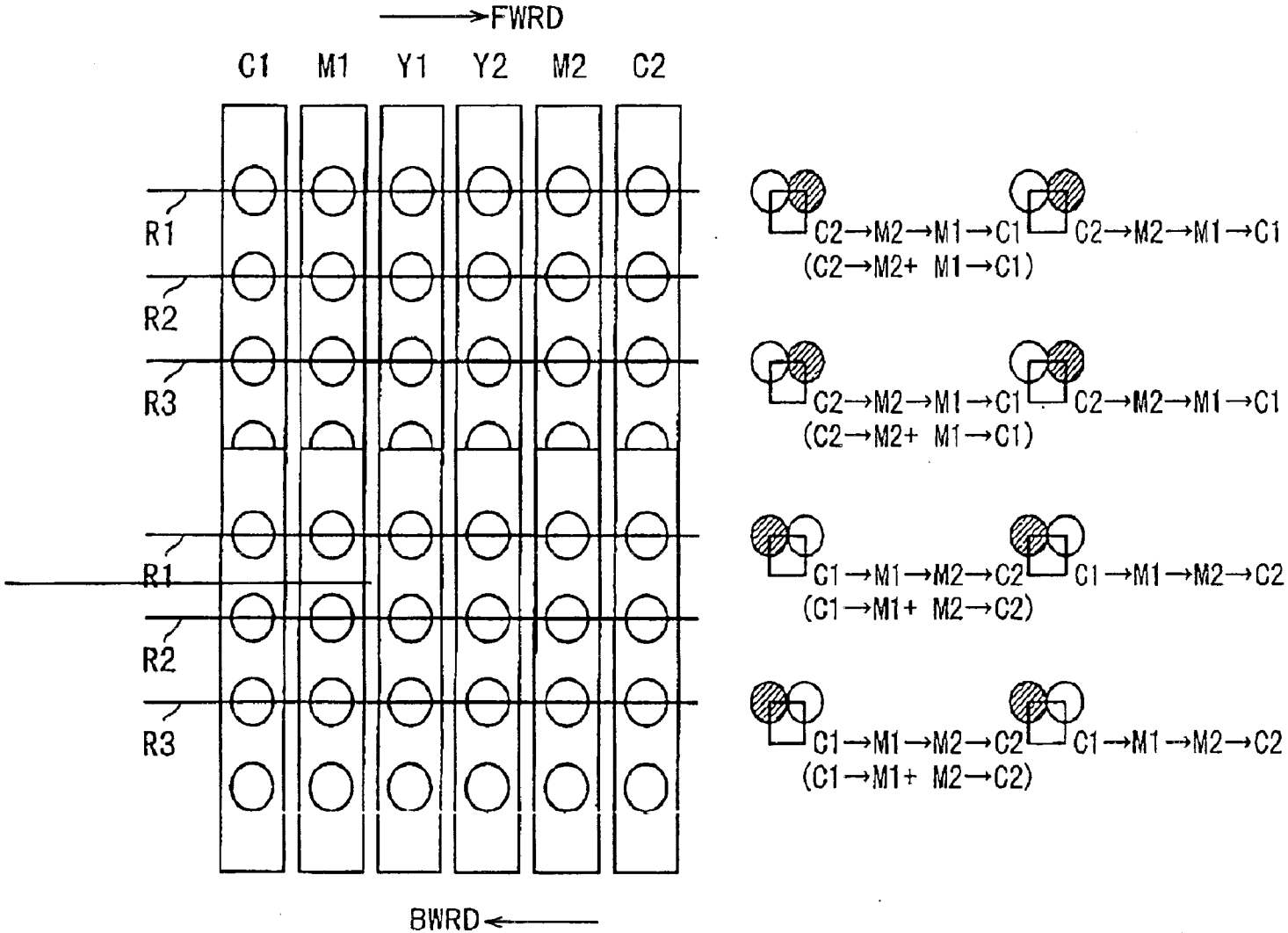
FIG. 11 shows a state in which a high density portion is printed in Embodiment 1.

In FIGS. 10, 11, there is shown a bi-directional print according to this embodiment of the present invention. In this embodiment, the distribution circuit 207 functions to allocate the dots for the data for each color as shown in FIG. 9. In FIG. 9, the dots are disposed at positions deviated in the main scan direction, but this is not limiting, and the dot-on-dot allotment or another deviation is usable.

FIG. 9, (a) shows a relation of allotment between the input data to the cyan (C) and the dot. No dot is allotted to the cyan data 00. For the data 01, the distribution circuit 207 for storing the data in the print buffer 205C1 shown in FIG. 7, stores the data in the print buffer 205C2 such that incidence probabilities are substantially uniform. The dot arrangement for the data 01 is either one of those shown in the Figure, (a) at 01.

For the data 10 providing the maximum density, two dots are allotted, and therefore, the data are allotted to the print buffers 205C1, 205C2, respectively in FIG. 7, so that dot arrangement is as shown in the Figure, (a) at 10.

In the Figure, (b), a positional relationship between the magenta (M) input data and the dot allotment, but the detailed description will be omitted since it is substantially the same as the case of cyan color.

The Figure, (c) shows a positional relationship between the input data for the blue (secondary color) and the positions of the dots. In the case of the primary color (cyan and magenta) described above, no concentration is necessary to the order of shots, because there occurs no difference in coloring. However, in the case of the secondary color, the order is to be considered since otherwise the difference occurs in coloring.

In the Figure, (c), the input data are shown as for the blue color, and actually, the uniform signal levels or values 00,01, 10 are supplied for the cyan and magenta colors.

For the input data 00, no dot is allotted. For data 01, there are four types as shown in the Figure, (c). For the data 01, the dot arrangements are determined by the result of distribution of the distribution circuit 207 for C, M colors respectively, there are four types of arrangement in each of the forward and backward paths. In the simplest system, the data 01 may be reproduced simply with the four combinations.

In such a case, the distribution may be alternating (sequential) distribution of the data to the plurality of (two, here) to the buffers or may be random distribution. What is desired is that orders of ink applications are not one-sided. More desirably, the incidences are fifty—fifty for the above-described reasons.

When it is desired that spatial frequency is raised by reducing the intervals between the dots in an image so as to reduce the roughness of the image, that complete overlap of the dots is avoided or that non-uniformity in the form of stripes, the distribution circuit 207 may effect the distribution on the basis of checking of the appearances of CMY so as to avoid the overlapping of the dots.

In the case of the data 10, the respective combinations can be provided in each of the forward path and the backward path, but, as described in the foregoing, for each of the pixels, the order of shots is the same, and therefore, the same coloring can be provided.

With FIG. 9, the description has been made with respect to the dot allotment for the cyan and magenta colors and blue color which is a secondary color provided by them, the same applies to the yellow and the other secondary color (green and red).

FIG. 10 illustrates a bi-directional print in which the cyan and magenta data 01 are uniformly contained in a pixel for the method of this embodiment. In this case, the order of shots is reverse for each column having the data in the forward path and the backward path (C2 and then M2: and M1 and then C1), and therefore, the color reproduction is substantially uniform, macroscopically.

FIG. 11 illustrates a bi-directional print in which the cyan and magenta data 10 are uniformly contained in a pixel through the method of this embodiment. In this case, the order of shots is the same (symmetrical) in the forward path and the backward path, so that substantially uniform color reproduction is accomplished.

(Embodiment 2)

Figure 12:
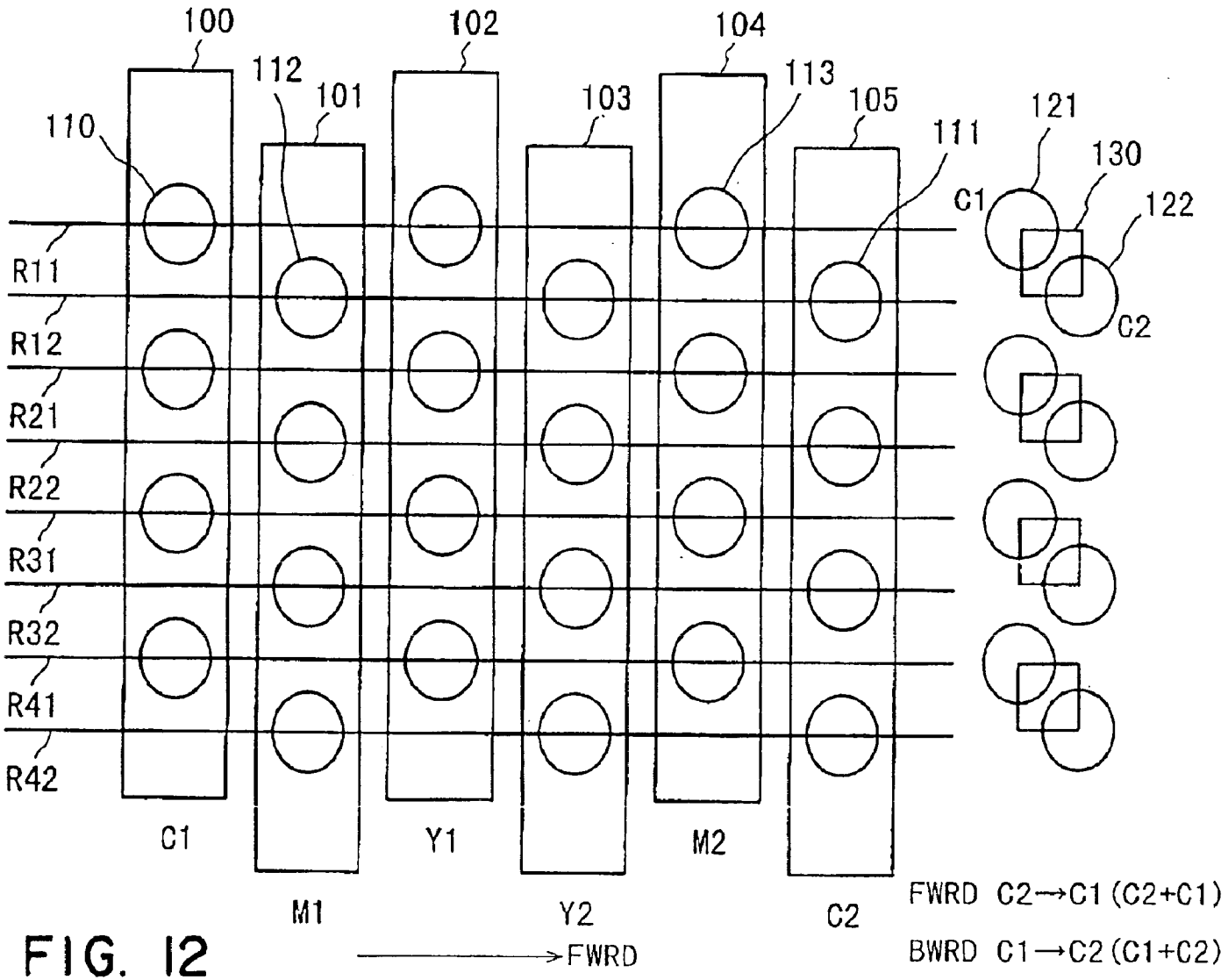
FIG. 12 shows a recording head, an allotment of ejection nozzles and a pixel according to an embodiment of the present invention.

FIG. 12 is a schematic view of a major part of a recording head portion of a head cartridge 1 according to another embodiment of the present invention. In this Figure, the constituent-elements are the same as the constituent-elements of the recording head portion shown in FIG. 3. However, the structure of the recording head portion used in this embodiment is different in that pair of the recording heads for the same color for a pixel for each color is deviated relative to the pitch of the nozzles of the recording head by ½ pitch in the sub-scan direction.

With this structure, the Figure shows the case in which the primary color (cyan) is printed.

The printing the defective with a pair of two dots at a dot position 121 and a dot position 122 to provide the maximum pixel density for the pixel 130. The dot position 121 and the dot position 122 in the Figure are the positions allotted to the dot elected from the ejection nozzle 110 of the recording head 101C1 and the dot ejected from the ejection nozzle 111 of the recording head 105C2 in the pixel (pixel) 130 area. Here, the dot position 121 is an upper left position of the diagonal line, and the dot position 122 is a lower right position thereof. Designated by R11, R12 are main-scanning lines for forming a pixel 130 (raster line). In this example, one pixel is printed by 2 raster lines.

Figure 13:
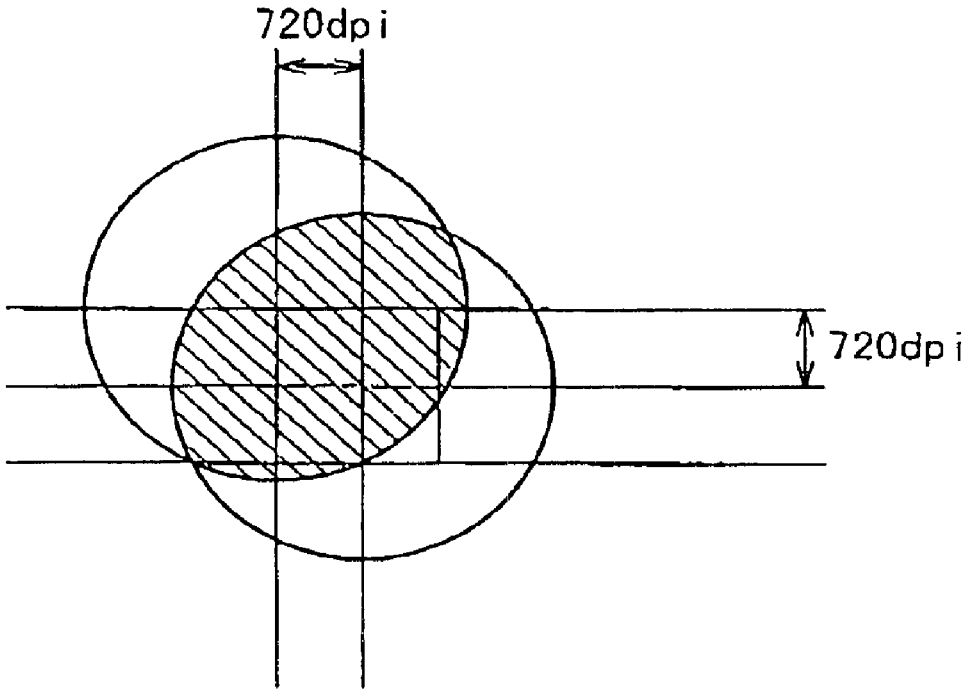
FIG. 13 shows an overlapping of dots in a pixel.

In the forward path in which the head cartridge 1 moves in the direction indicated by an arrow in FIG. 12, the order of the shots to the pixel 130 is the recording head 105C2 and then 100C1, and in the backward path, the order is C1 and then C2. In the case of the primary color, the same color inks are deposited, and therefore, there occurs no difference in coloring due to the order of shots. In this Figure, the dot position 121 and the dot position 122 are not shown as being overlapped, but actually, as shown in FIG. 13, the dots are partly overlapped in normal situations.

Figure 14:
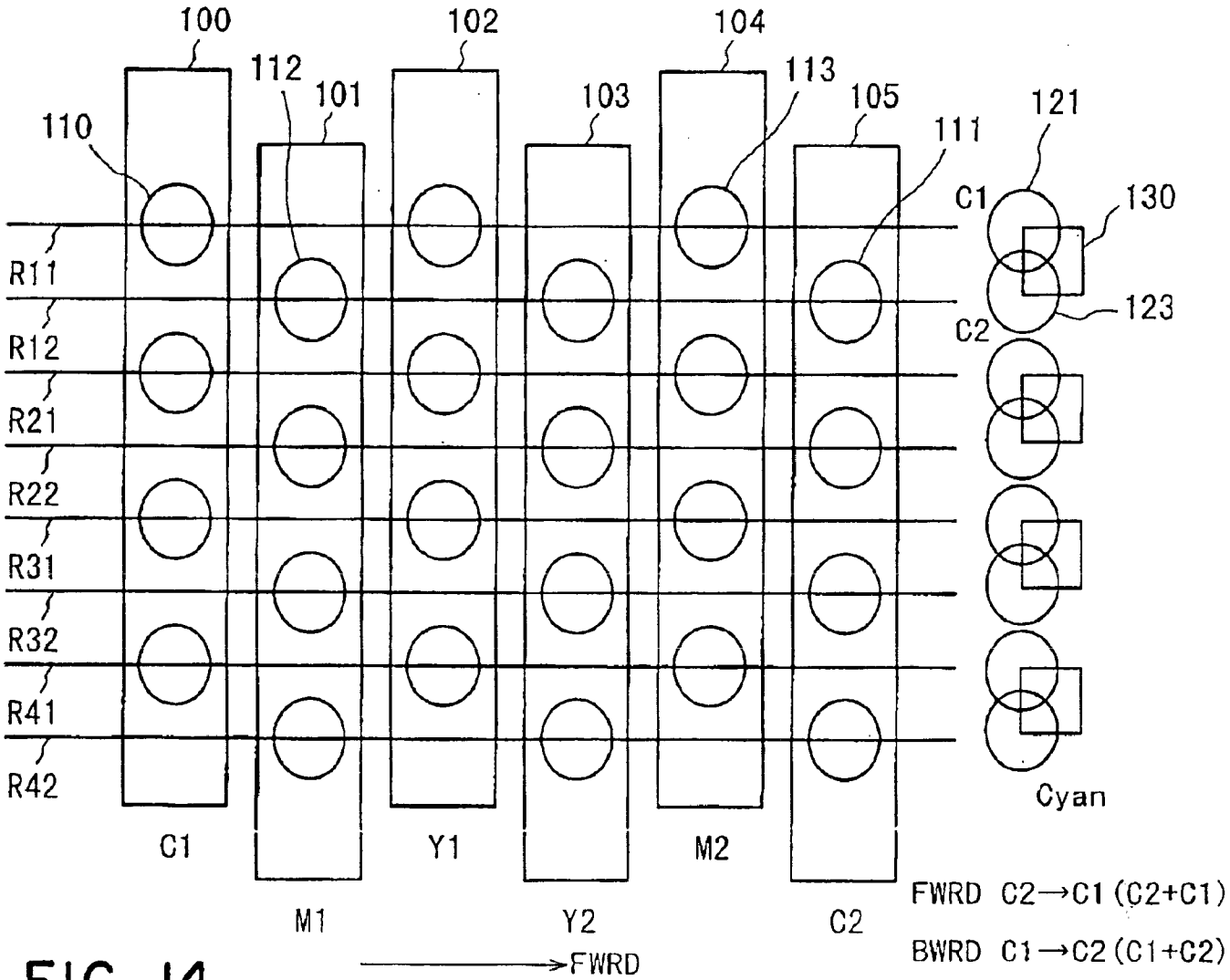
FIG. 14 shows an example of a recording head, an allotment of ejection nozzles and a pixel.

FIG. 14 illustrates a case in which they use is made with a head cartridge 1 having the same structure as with FIG. 12, and the dots are allotted to the dot positions 121, 123 on the pixel 130. In such a case, the dots are for the same primary color, so that no difference in the coloring occurs between the forward path and the backward path.

Figure 15:
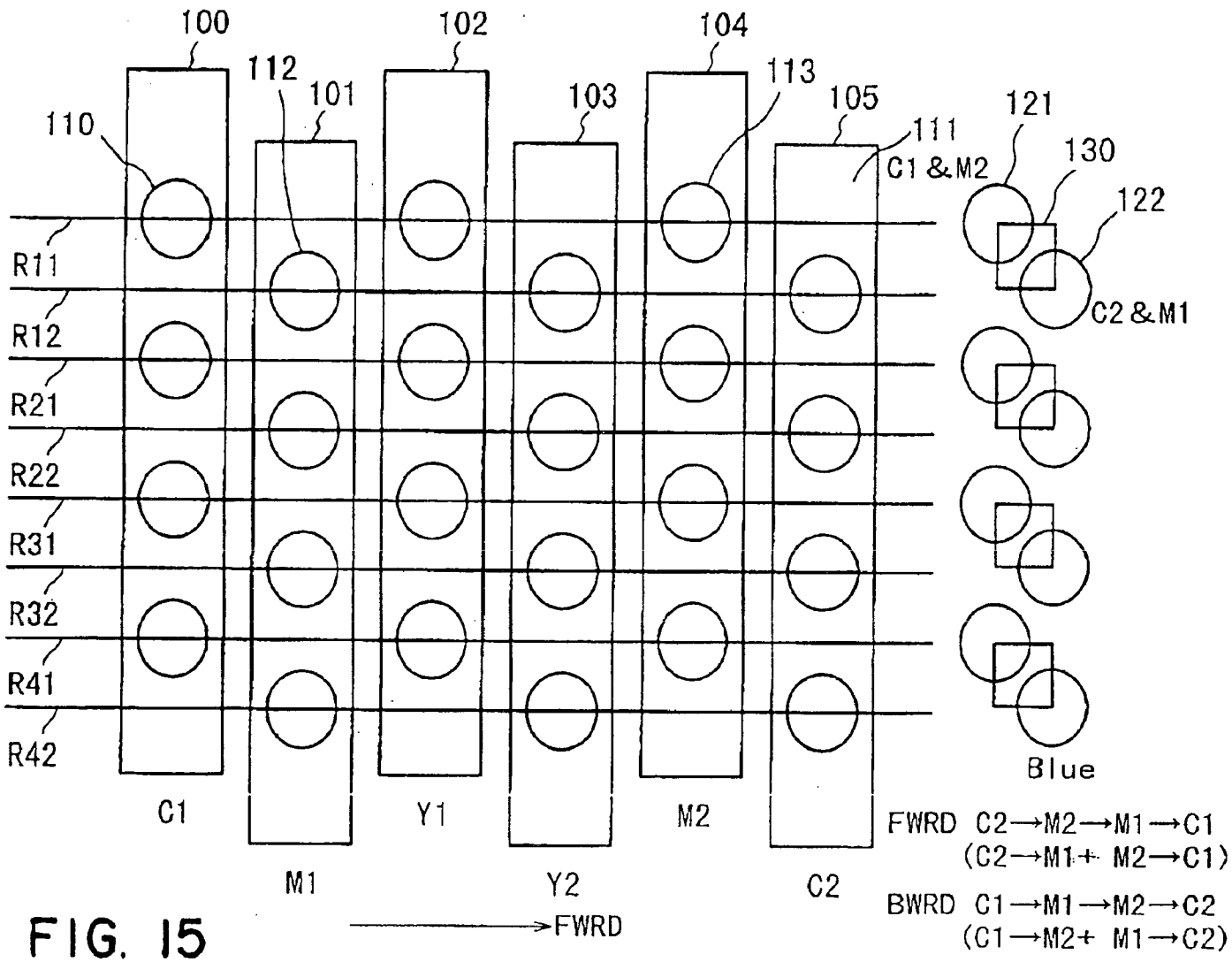
FIG. 15 shows an example of a recording head, an allotment of ejection nozzles and a pixel.

FIG. 15 illustrates a case in which a head cartridge having the same structure as with FIG. 12, the cyan and magenta dots are allotted to the dot positions 121, 122 on the pixel 130. In such a case, as is different from the pixel 130 structure shown in FIG. 12, the dot-on-dot structure is provided for each color and for each pixel. Similarly to the case of FIG. 6 (Embodiment 1), a uniform coloring property is provided for each pixel 130.

Microscopically, the differently colored pixels are alternately arranged for each rasters. But, macroscopically, the pixel structure is symmetrical in the order of shots, more particularly, the cyan dot form C2, the magenta dot from M2, the magenta dot from M1 and cyan dot from C1 in the forward path, and the cyan dot from C1, the magenta dot from M1, magenta dot from M2 and cyan dot from C2 in the backward path. Therefore, as for the unit of pixel, the intermediate blue coloring is uniformly provided.

In the present invention, it is important in the present invention that when the density of the pixel is maximum, it is dominant that different color inks are shot to the pixel in a symmetric fashion. Similarly to Embodiment 1, the uniform coloring property can be provided at all times at the pixel 130.

When the maximum density for the pixel is to be provided, it is desirably dominant that order of shots of colors forming the secondary color is symmetrical in a pixel. In this example, the blue (cyan plus magenta) is taken as an example of the secondary color, but the same applies to the red (magenta plus yellow) or to the green (cyan plus yellow).

Figure 16:
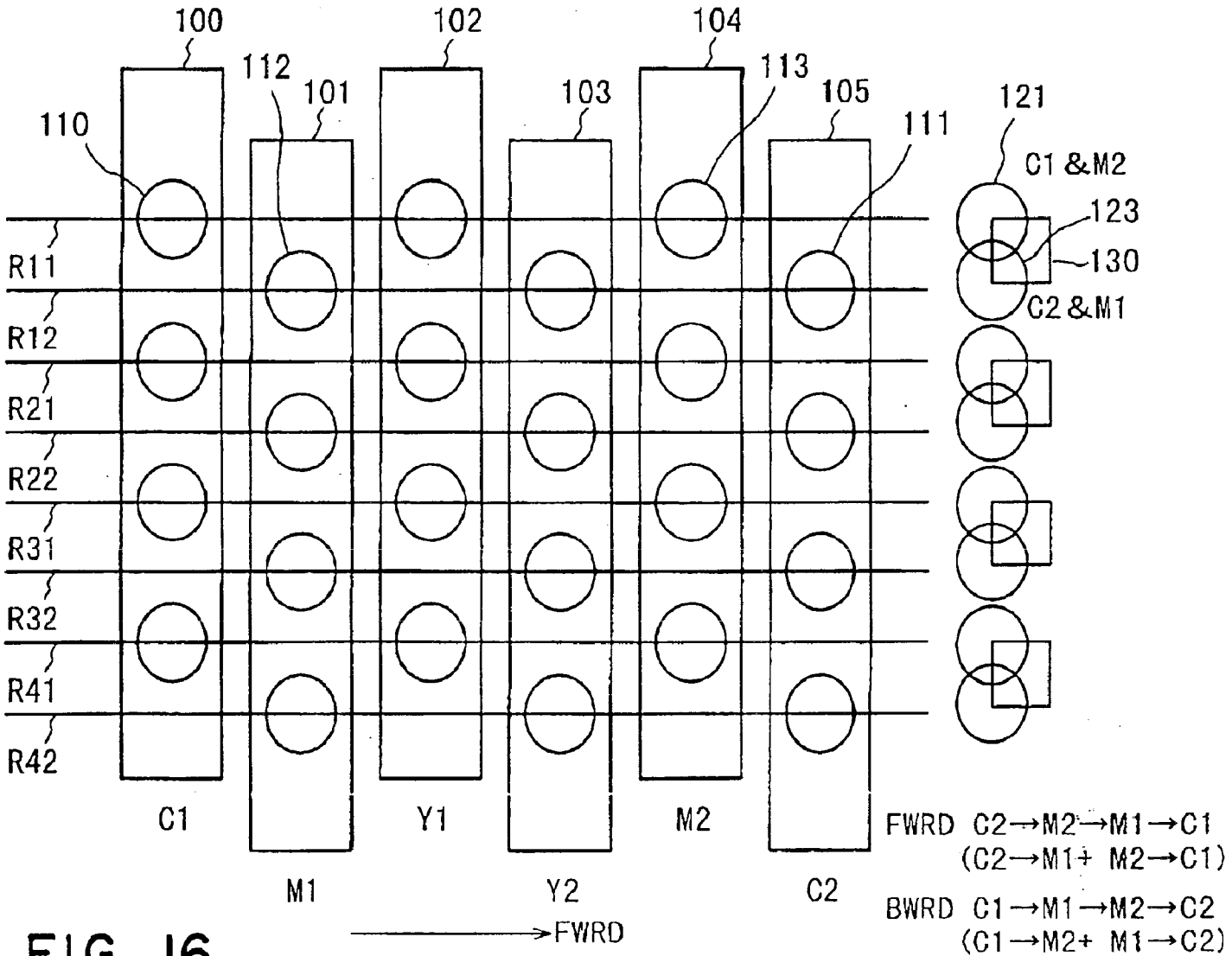
FIG. 16 shows an example of a recording head, an allotment of ejection nozzles and a pixel.

FIG. 16 illustrates a case in the use is made with a head cartridge 1 having the same structure as the head cartridge shown in FIG. 12, and the dot is allotted to the dot position 121 and the dot position 123 of the pixel 130 in a dot-on-dot fashion for each color. In the situation, similarly to FIG. 15, the coloring property is uniform as for the pixel 130.

The description has been made as to the case in which the maximum density is reproduced in each pixel. Now, the reproduction using bi-directional print for reproducing the half-tone in the pixel will be described. More particularly, multi-value data are received in this example. The multi-value data and the change of the order of shots are the same as with the foregoing embodiment, and therefore, the description therefor is omitted.

Figure 17:
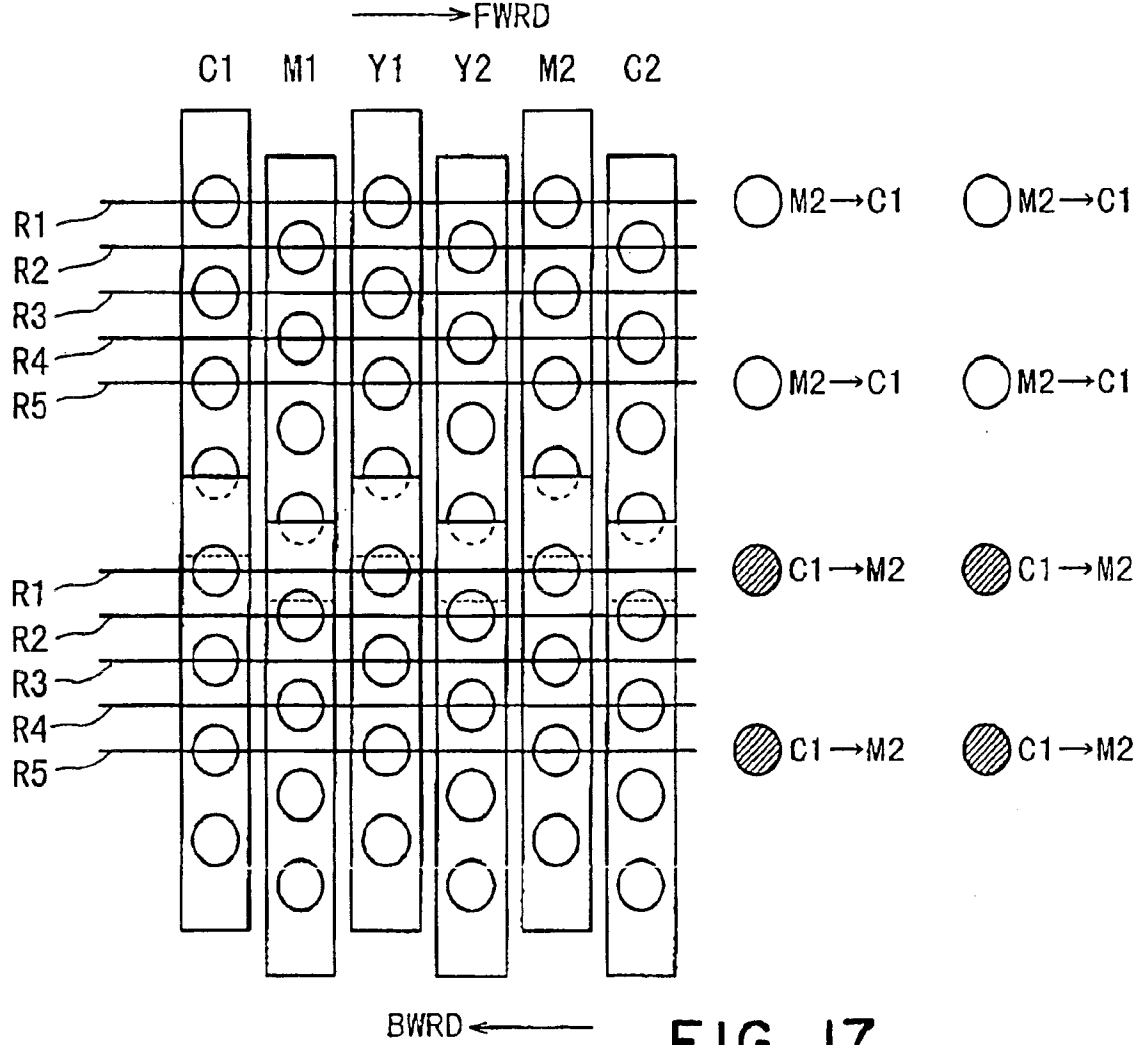
FIG. 17 shows a cause of occurrence of color non-uniformity due to interference of data in a bi-directional printing operation in a conventional example.

FIG. 17 shows a conventional example in which the used recording nozzles are synchronised due to synchronism between the recording data to be subjected to the bi-directional print and the positions of the recording nozzle arrays. On rasters R1 R5, colorings of the dots at a column position when a half-tone, lateral line or hatching is printed at the dots having blue dot data (cyan and magenta).

In the forward path, the magenta (M) ink is first printed, and the cyan (C) ink is then printed, but in the backward path, vice versa. The difference in the coloring still occurs depending on the print data between the forward path and the backward path even if the yellow, magenta, cyan heads are arranged symmetrically.

As will be understood from the Figure, when the blue (mixture of cyan and magenta colors) is printed, there occurs dots in which the order of shots is the same, in each of the forward path and the backward path, with the result of color non-uniformity in the form of bands in the scanning direction.

Figure 18:
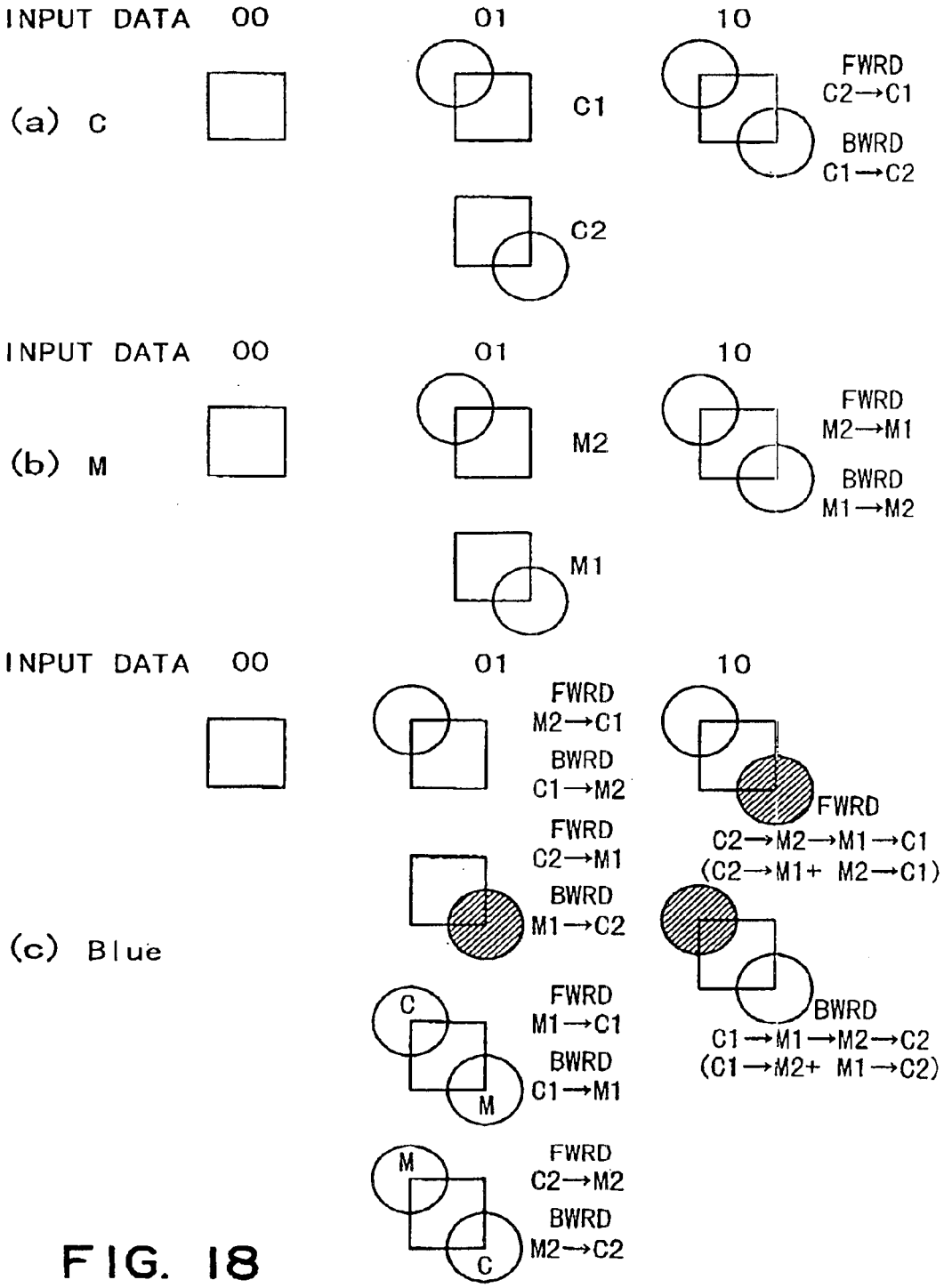
FIG. 18 shows a relation between input data and allotted dot positions in Embodiment 2.
Figure 19:
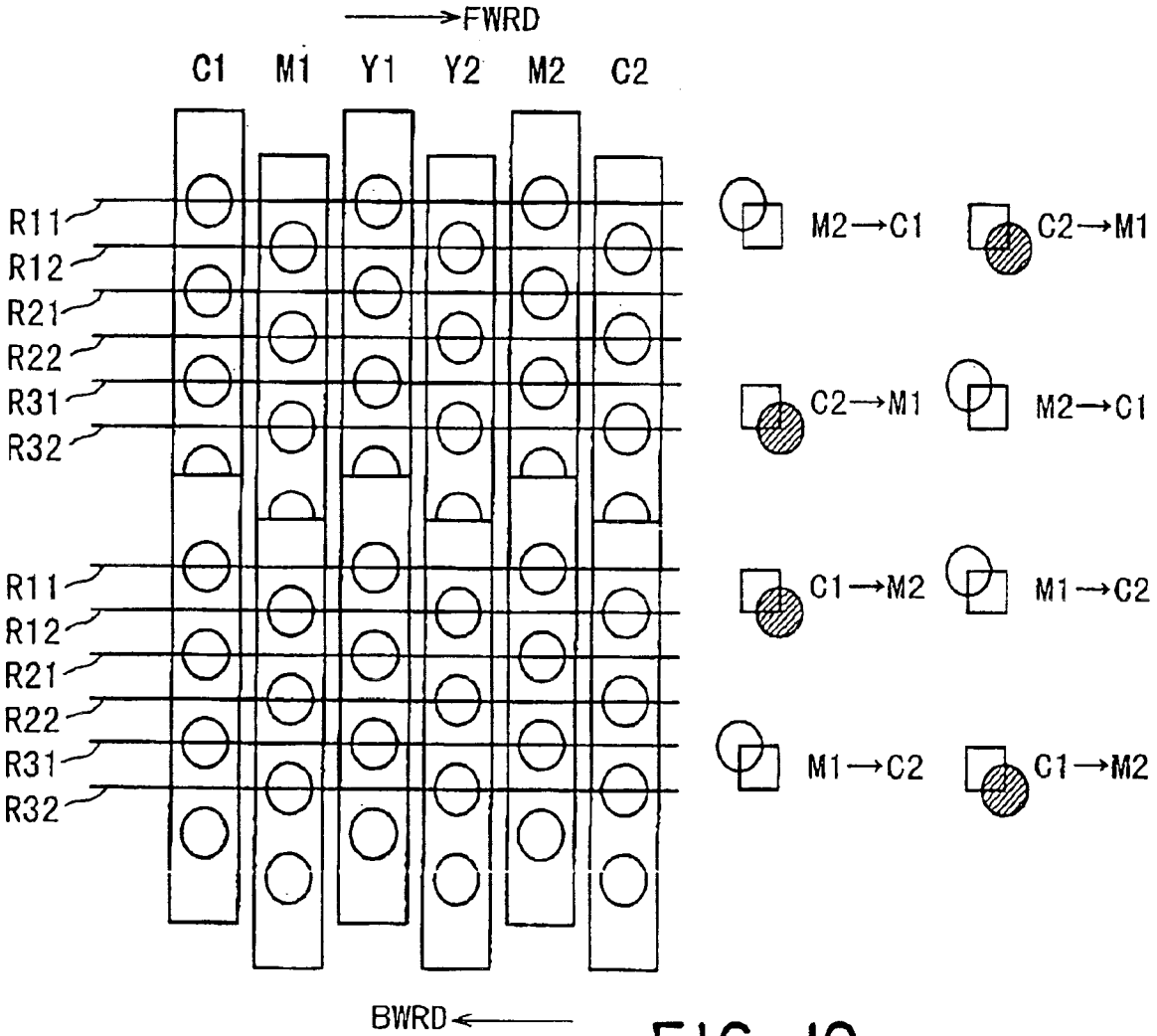
FIG. 19 shows a state in which a low density portion is being printed in Embodiment 2.
Figure 20:
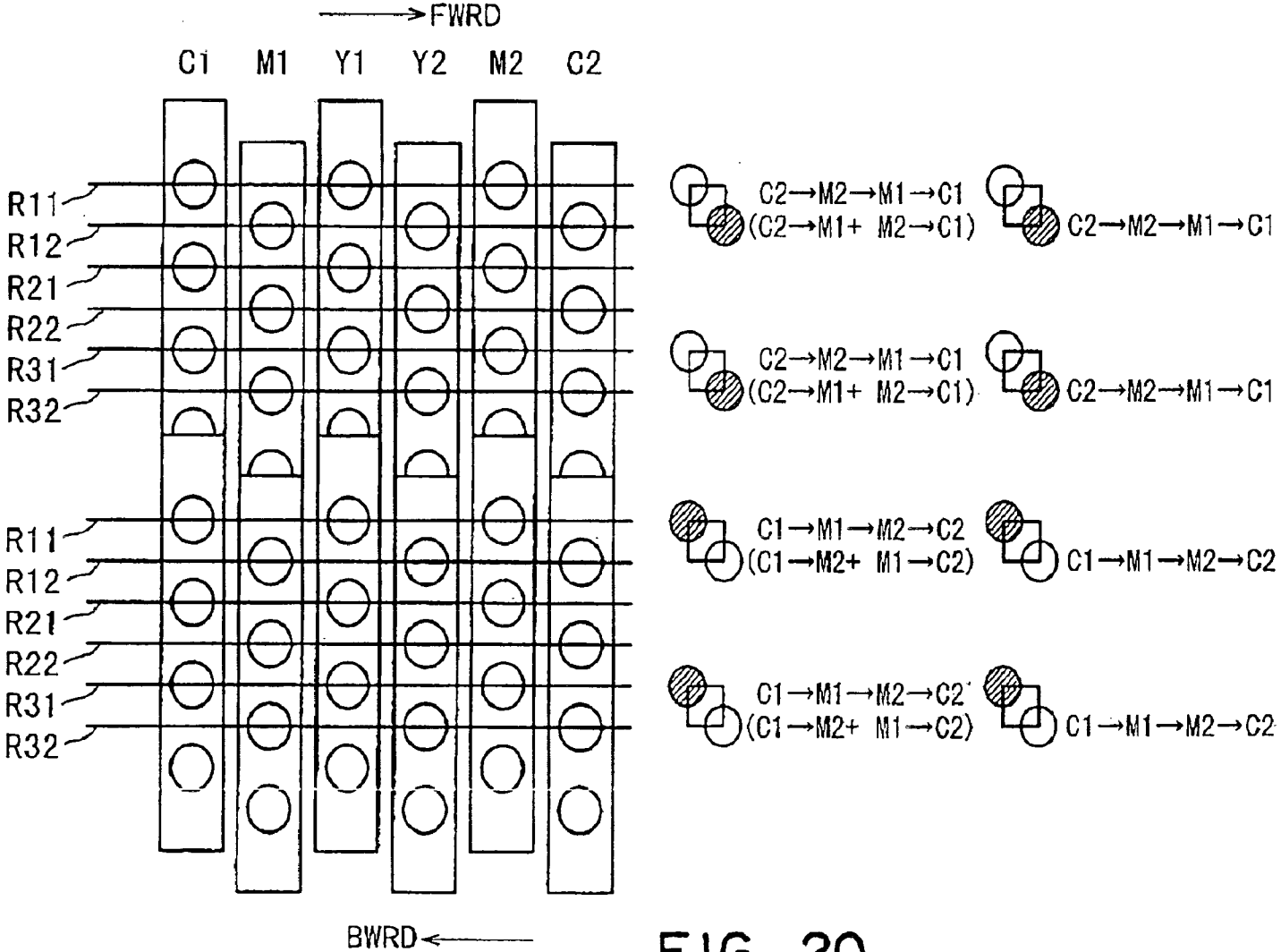
FIG. 20 shows a state in which a high density portion is being printed in Embodiment 2.

FIGS. 19, 20 show the bi-directional printing in the embodiment. In this embodiment, the distribution circuit 207 having been described in the foregoing distributes or allots the data of respective colors to the dot positions, as shown in FIG. 18. The dot allocation of FIG. 18 is similar to FIG. 9, and therefore, the detailed description is omitted. As for the magenta (M) in FIG. 18, the arrangement of the recording heads M1, M2 is deviated by ½ dot pitch, and therefore, the head and dot positions are opposite from those of FIG. 9.

In FIG. 18, the blue dot allocations which is a secondary color of cyan plus magenta has been described, but the same applied to the yellow and the other secondary colors (green and red).

FIG. 19 shows a state in which the bi-directional print is carried out through a method of this embodiment when the cyan and magenta data 01 are contained uniformly for each color in a pixel. In such a state, the order of shots are reversed for each column having the data (C2 and then M1; and M2 and then C1), and therefore, substantially macroscopically uniform color reproduction is accomplished.

FIG. 20 shows a state in which the bi-directional print is carried out through a method of this embodiment when the cyan and magenta data 10 are contained uniformly for each color in a pixel. In this case, the order of shots are the same (symmetrical) in the forward path and in the backward path, and therefore, substantially uniform color reproduction is accomplished.

(Embodiment 3)

In the foregoing embodiments, the bi-directional non-uniformity in the single-path bi-directional print is removed using the symmetrical head adapted to the bi-directional print. However, the present invention is effectively applicable also to the case in which the bi-directional print is carried out using a known head in which the recording elements are arranged in the order of colors such as CMYK in the main scan direction.

This embodiment is characterized in that bi-directional non-uniformity is avoided when the bi-directional print through at least two paths is carried out using a recording head in which the recording elements are simply arranged in the main scan direction, for example, CMYK. In this embodiment, similarly to the foregoing embodiment, the control is effected such that incidence probabilities of pixels at which the orders of shots are different, are substantially the same in the raster one direction, in a low density portion. Furthermore, the order of shots for the pixel is made symmetrical for at least one color in a high density portion in a further preferable control. By doing so, the bi-directional color non-uniformity resulting from the synchronism with the recording data is reduced.

The present invention is not limited to this combination, but may use the above-described control only at the low density portion. Selection out of the methods is a matter of design specifications and is properly made by one skilled in the art in consideration of the dot size, the maximum density or the like.

Figure 21:
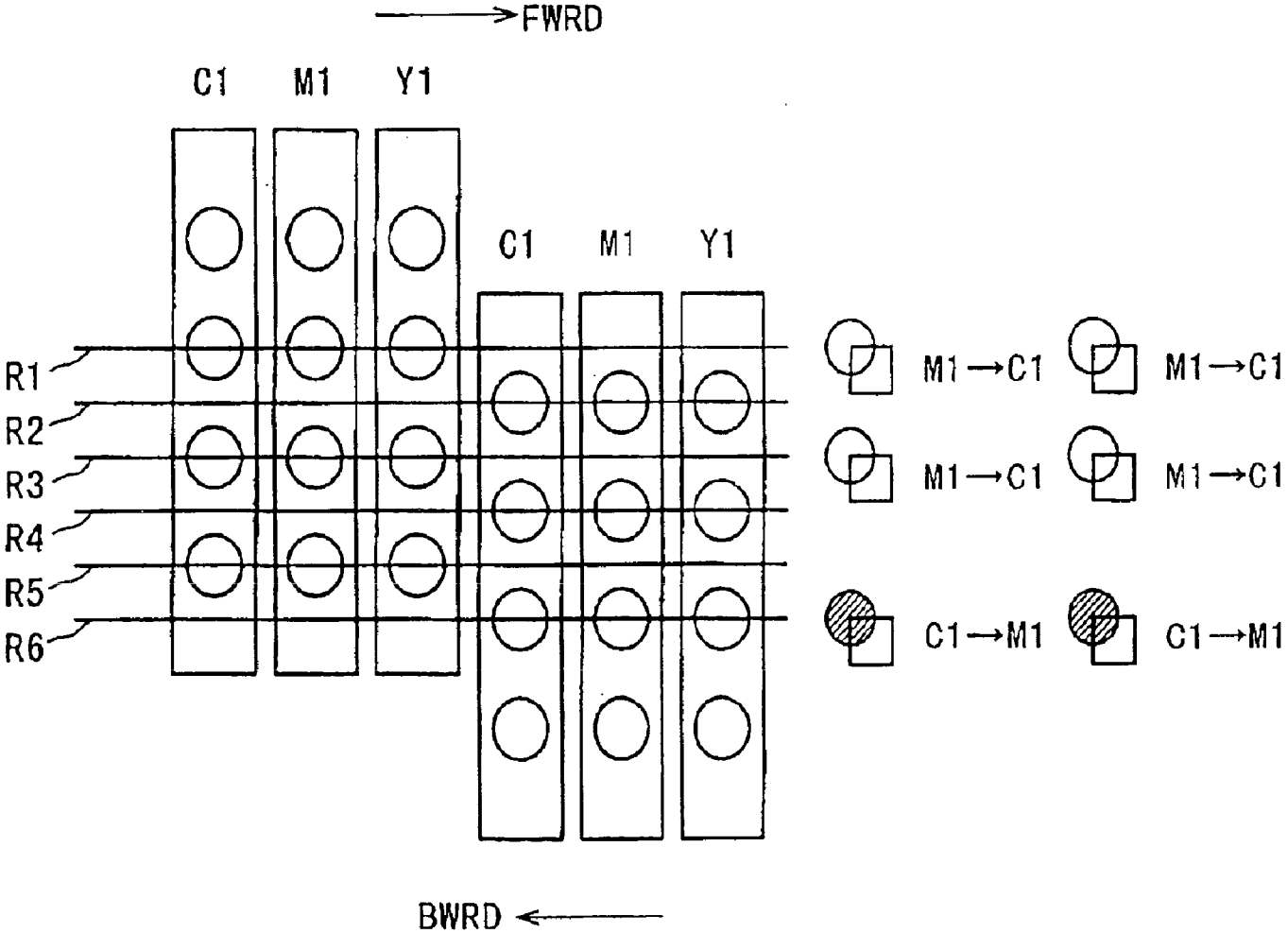
FIG. 21 shows synchronism between recording data and forward scanning or backward scanning in a conventional example.

The description will be made as to a bi-directional multi-path print using a recording head in which the C, M, Y recording elements are arranged in a lateral direction. FIG. 21 represents a conventional FIG. 21, and FIGS. 22, 23 and 24 show this embodiment. In either case, the recording head scans in the forward path direction, and then, the recording heads are moved relative to the recording sheet by one half of the number of the recording elements (2, here) ±½ of the number of the recording elements, namely, 1.5 recording element pitch and 2.5 recording element pitch, and thereafter, the recording head scans in the backward path direction, this effecting the multi-path printing.

In the conventional example shown in FIG. 21, an example is taken in which the data to be printed are such that when blue color (secondary color) is printed, one cyan dot and one magenta dot are allotted in a dot-on-dot fashion in each pixel. There occur many other combinations, but this combination is taken for easy understanding.

As shown in this Figure, in the conventional manner, the dot allotment is such that there are blue dot data on the raster lines R1, R3 in the forward path print and blue dot data in the raster line R6 in the backward path. Therefore, the incidence of one or another order of shots due to interference with the print data is determined by the scanning direction. When the distribution of the forward path print and the backward path print in the dither pattern print or the like is not uniform, the coloring is not uniform.

Figure 23:
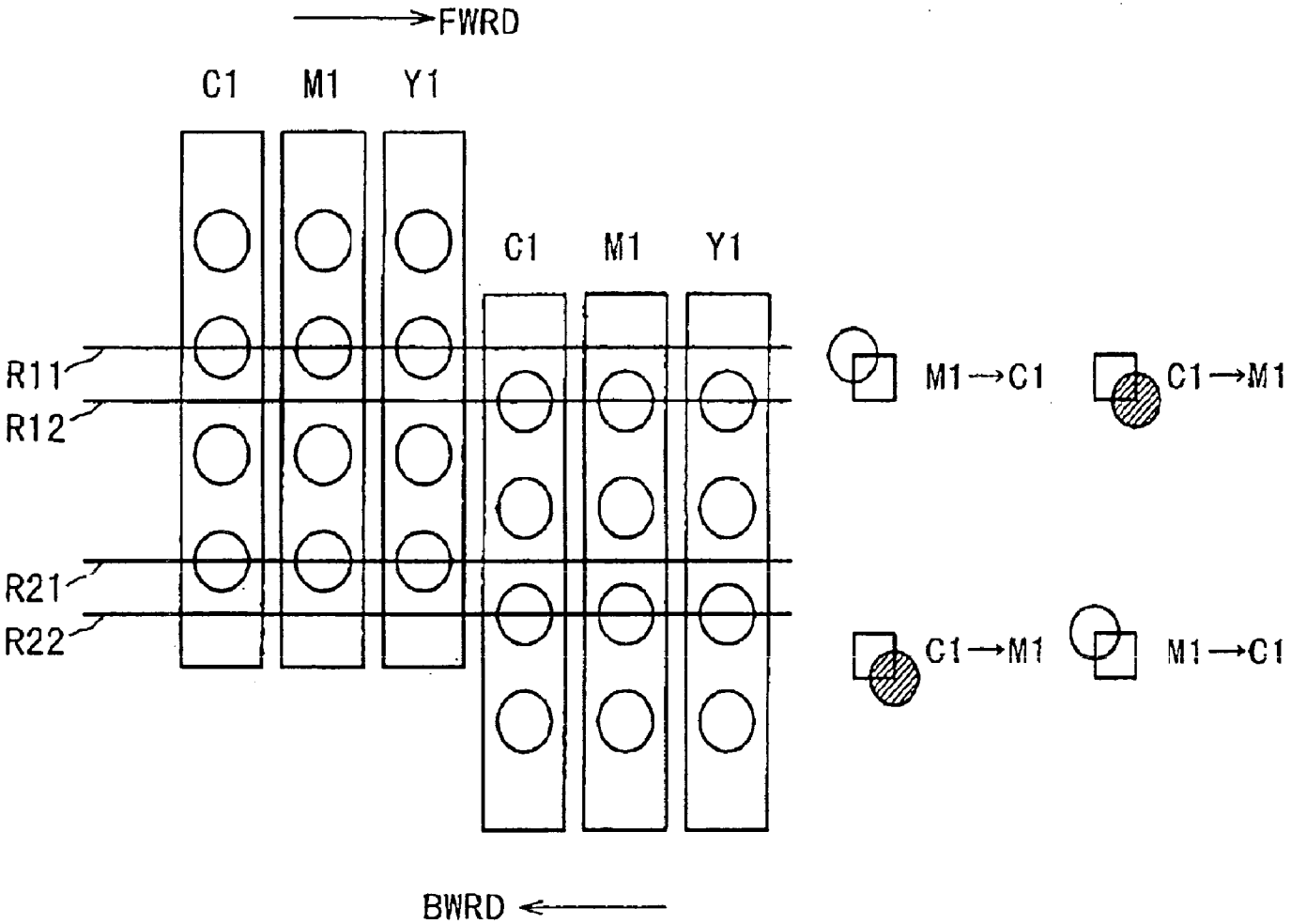
FIG. 23 shows a state in which a low density portion is being printed in Embodiment 3 of the present invention.
Figure 24:
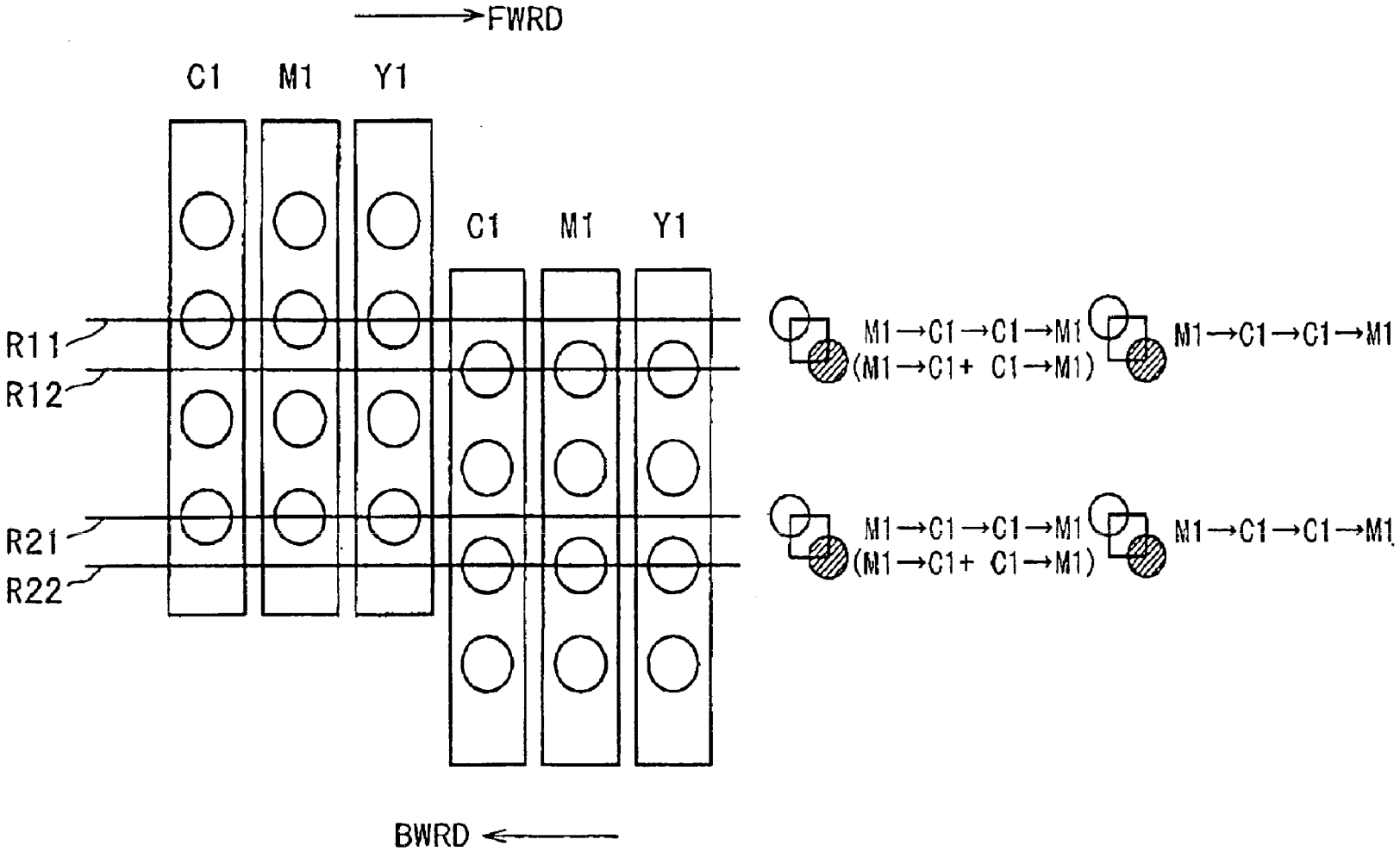
FIG. 24 shows a state in which a high density portion is being printed in Embodiment 3.

FIG. 23 shows a state in which half-tone printing operation is carried out in this embodiment. FIG. 24 shows a state in which a fully-solid printing is carried out. In FIG. 23, the probabilities of the dots where the order of shots are different in the rasters R11, R12 and R21, 22 in the forward scanning print and in the backward scamming print are substantially the same, so that coloring is made uniform. In FIG. 24, 1 pixel is constituted by rasters R11, R12 or by R21, 22, and the pixel is constituted by a pair of a dot printed in the forward path and a dot printed in the backward path, by which the coloring is made uniform.

Figure 22:
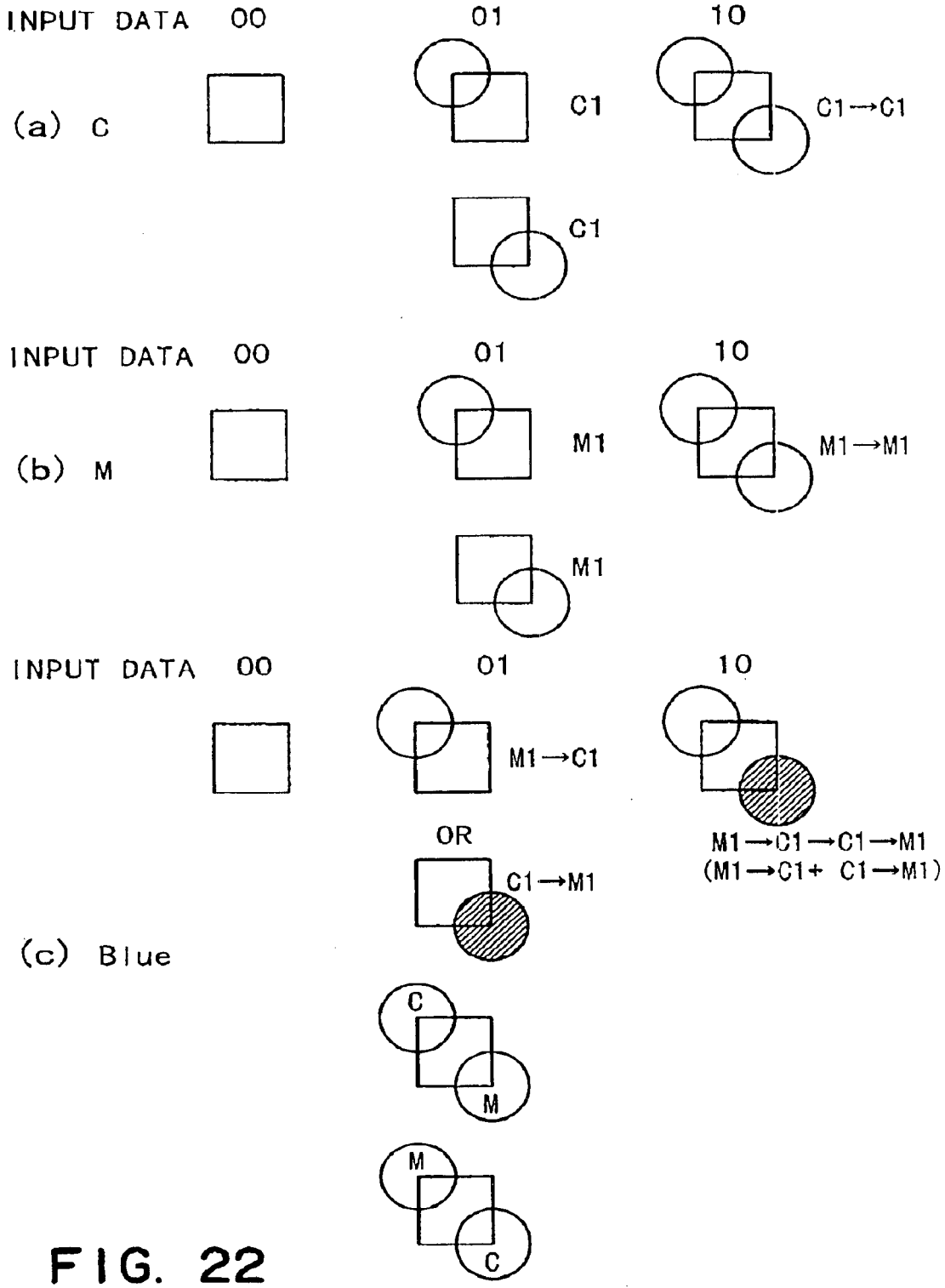
FIG. 22 shows a relation between input data and allotted dot positions.

FIG. 22 shows a relation between the input data and the allotments of the dots. The Figure is drawn in the same manner as FIGS. 9, 18, so that detailed description is omitted.

In FIG. 23 and FIG. 24, the dots printed in the bi-directional print are interraced (deviated by ½ pitch), but the same is fundamentally applied to a multi-path print of a type in which complementary thinning masks are used, and the dots are allotted on the rasters at the dot pitch. The same applies to the case in which the feeding in the sub-scan is effected at an interval which is an integer multiple of the resolution of the recording element arrangement.

(Embodiment 4)

Figure 30:
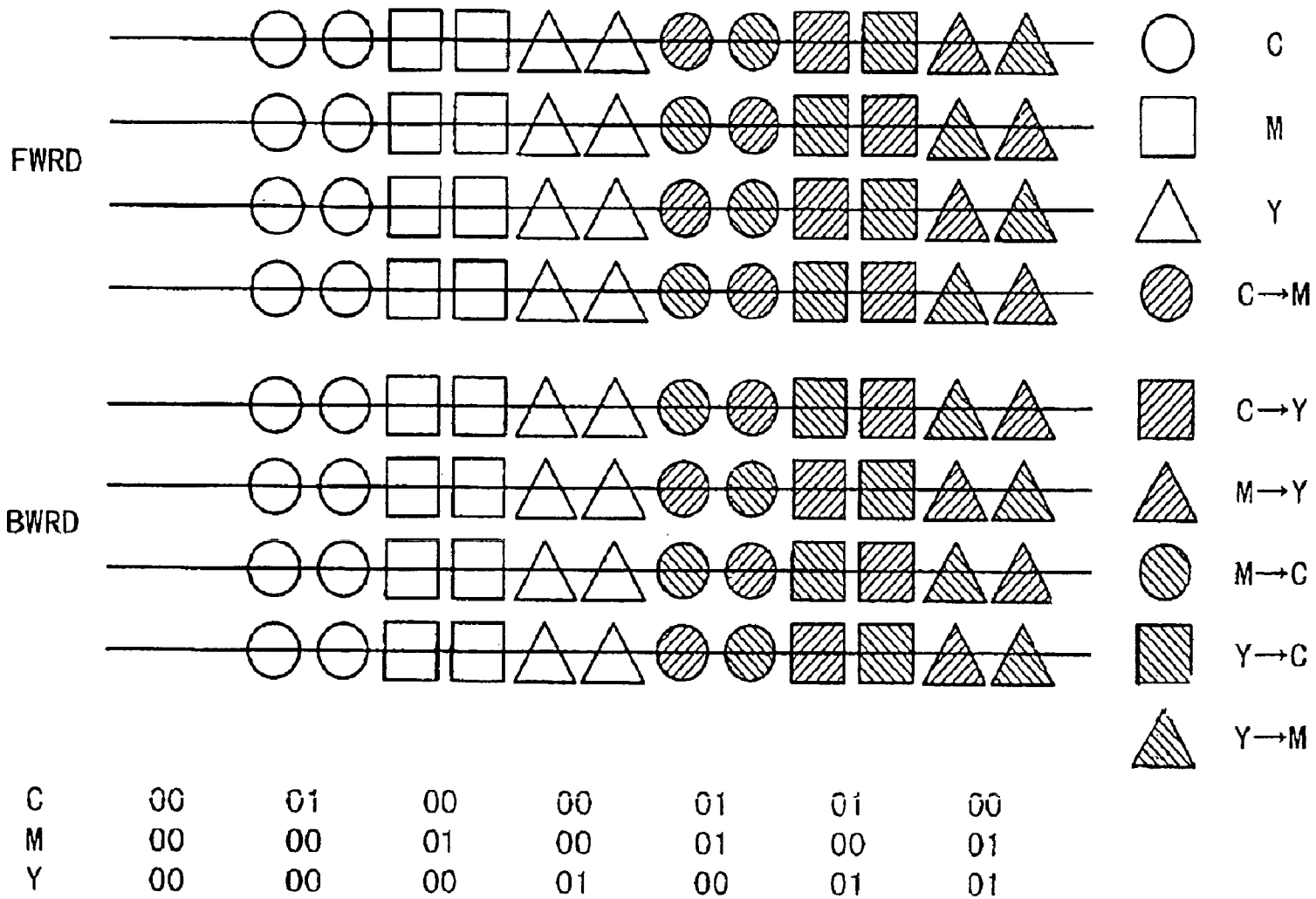
FIG. 30 is a schematic view of gradation from monochromatic Y, M, C color printed on the print medium to a secondary color.

FIG. 30 shows a color image formed on a recording material in the foregoing embodiment. The print schematically shows a gradation from each of monochromatic Y, M, C colors to secondary colors.

In a monochromatic pixel, the color non-uniformity attributable to the bi-directional printing does not arise in principle, but in this example, the secondary color pixels are printed in the orders which are different in the raster one direction, and therefore, the color non-uniformity attributable to the bi-directional printing is not macroscopically visible.

Therefore, the print thus provided using the present invention is remarkably good.

The symmetrical shape recording head usable with the present invention is not limited to the structure shown in FIG. 3 and/or FIG. 12. For example, the recording heads shown in FIGS. 25 to 29 are considered as usable examples, but another structure is also usable if the advantageous effects of the present invention are provided.

Figure 25:
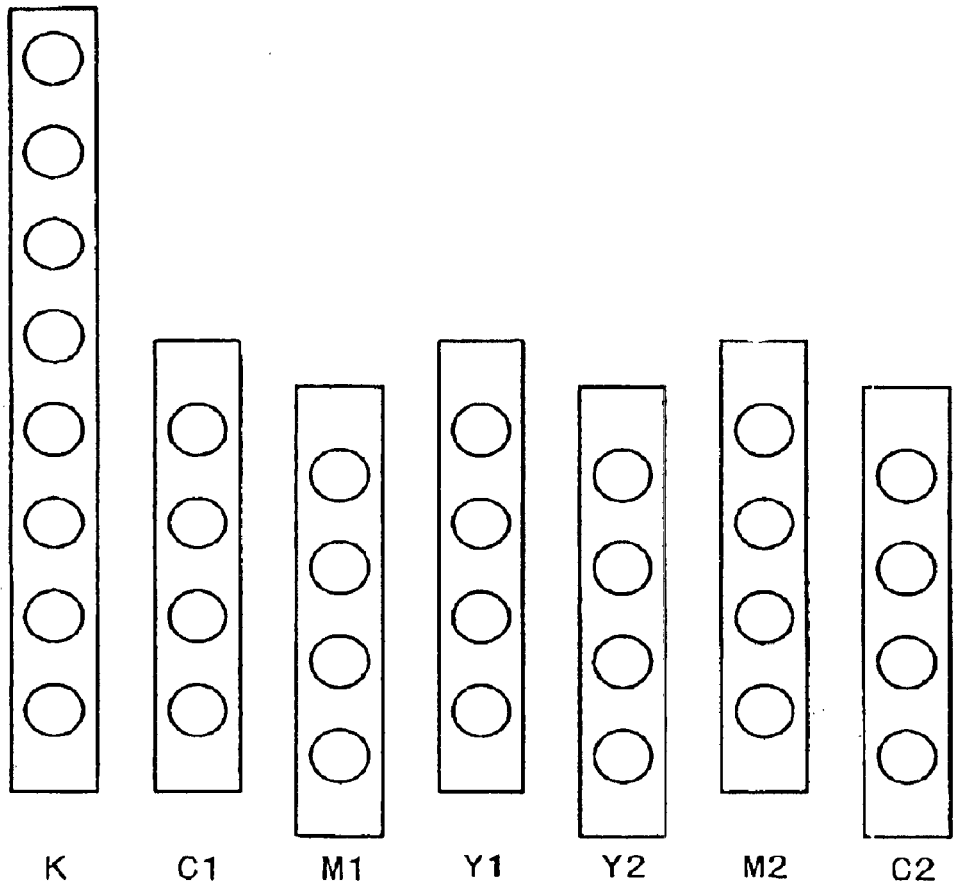
FIG. 25 shows another example a recording head and an allotment of ejection nozzles.

FIG. 25 shows an example having a recording head for the black color in addition to the structure shown in FIG. 12. The black is generally not used for printing the secondary color, and therefore, there is no need of symmetrical arrangement. In order to permit a higher speed printing operation in a monochromatic recording mode, the number of the nozzles for the black color is larger than that of the other chromatic head.

Figure 26:
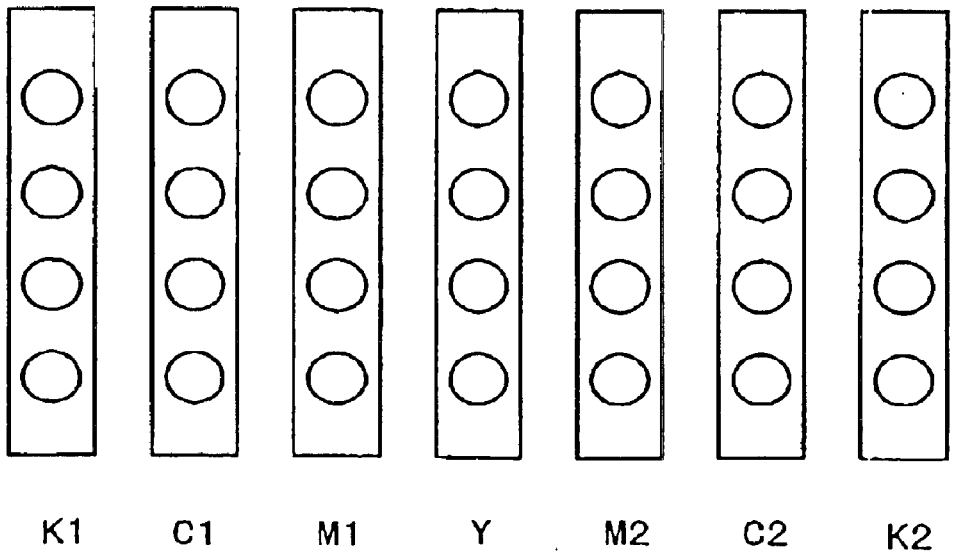
FIG. 26 shows a further example of a recording head and an allotment of ejection nozzles.

FIG. 26 shows an example having a structure similar to that of FIG. 3 but additionally having black recording heads for ejecting black (K) ink at the respective ends, wherein only one yellow (Y) head is provided at the center of symmetry to simple the structure. The recording head provided at the center of symmetry, ejects the ink later at all times, that is, irrespective of the scanning directions. In this example, the yellow is disposed at the center, but this is not limiting.

Figure 27:
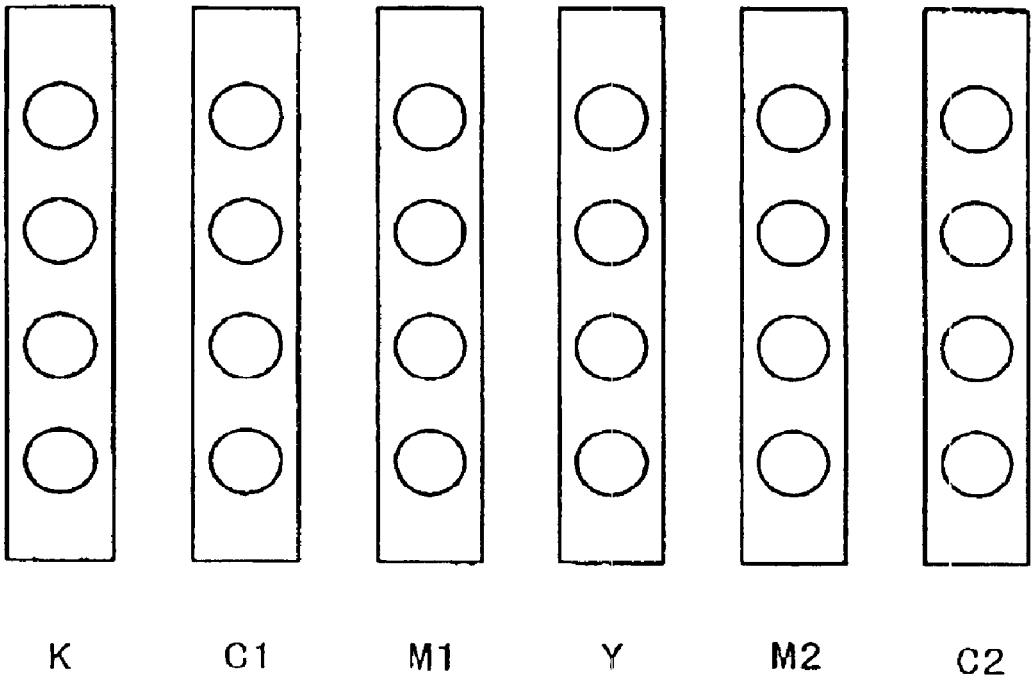
FIG. 27 shows a further example of a recording head and an allotment of ejection nozzles.

FIG. 27 shows an example having a similar structure as with FIG. 26, but it has only one recording head for the black (K) color printing, for the same reason as with FIG. 25 example.

Figure 28:
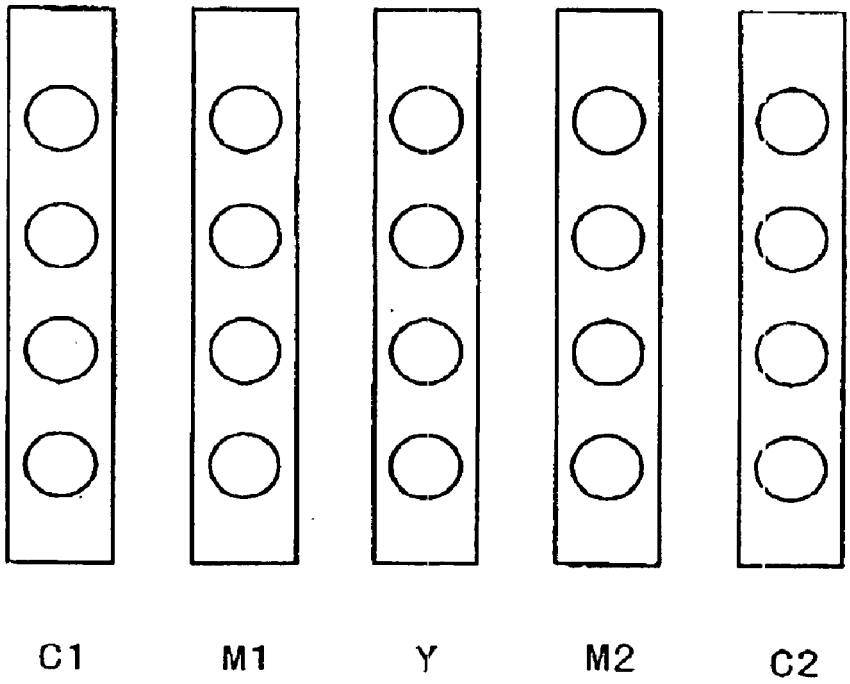
FIG. 28 shows a further example of a recording head and an allotment of ejection nozzles.

FIG. 28 shows an example having only one yellow head at the center of symmetry in the structure of FIG. 3, so that structure is simplified.

Figure 29:
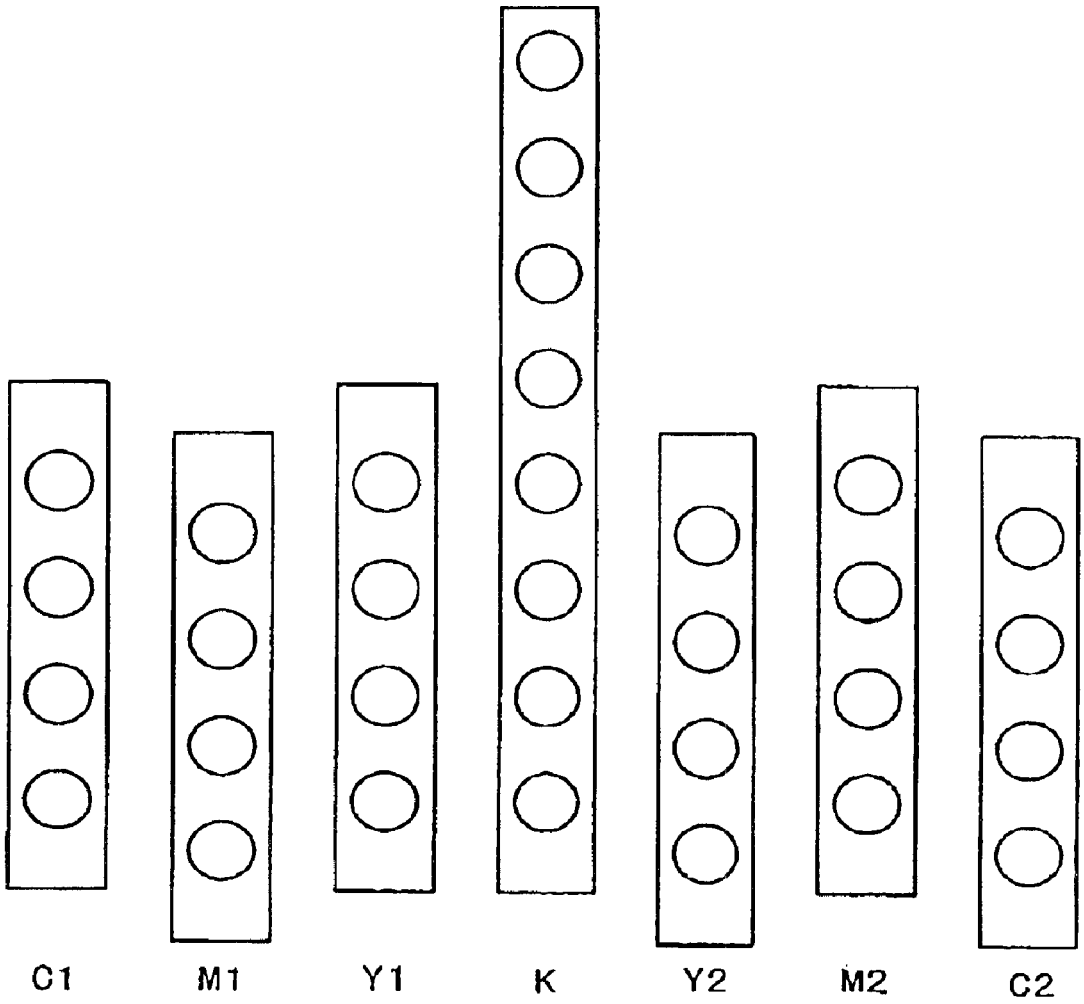
FIG. 29 shows a further example of a recording head and an allotment of ejection nozzles.

FIG. 29 show an example which is similar to FIG. 25 example but in which only one black head is provided at the center of symmetry.

As described in the foregoing, in each of the embodiments of the present invention, firstly as regards the low density portion, means is provided to make the incidence probabilities of the orders of shots of at least different colors in the forward path print are the same as those in the backward path print at least for the pixels where different color dots are combined, and secondly, as regards the high density portion, means is provided to make it dominant that at least when secondary or higher color is to be formed, the order of shots of the color inks is symmetrical wherein for at least one of the color inks used, a pixel is printed by two dots.

Therefore, the differences in the coloring which has conventionally caused by the synchronism with image data such as a line or the like and by the difference in the shot order at the high density portion can be avoided. Furthermore, the color non-uniformity attributable to synchronism with half-toning using dither method or the like in the half-tone portion and the low density portion can be suppressed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30 SUPo/SUPC and not higher than 70 SUPo/SUPC to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the occurrences of the color non-uniformity attributable to the order of ink applications in the bi-directional printing can be reduced independently of the data to be printed.

While the invention has been described with reference to the structures disclosed herein, it is not confined to the details set forth and this application is intended to cover such modifications or changes as may come within the purpose of the improvements or the scope of the following claims.

What is claimed is:

1. A printing apparatus for forming a color image by applying different color inks to a printing material using a recording head, while bi-directionally moving the recording head to scan the recording material, said apparatus comprising:

a record control means for controlling applications of respective different color inks, wherein said record control means applies a plurality of different color inks to secondary color pixel areas;

a changing means for changing an order of applications of the inks to be applied for printing a secondary color to a secondary color pixel area; and a forming means for forming the secondary color while making the order of applications of the inks to at least one of a plurality of the secondary color pixel areas arranged along a raster scan direction different from the order of another, by said changing means.

2. The apparatus according to claim 1, wherein said forming means forms the secondary color while changing by said changing means the order for substantially half the number of the secondary color pixel areas arranged along the raster scan direction.

3. The apparatus according to claim 1, wherein said recording head includes one or more sets of recording elements for application of the color ink, the recording elements constituting the set being arranged in the scanning direction symmetrically, and said changing means selects one of the recording elements constituting the set to make the order of applications of the inks to the pixel area different from the order of another.

4. The apparatus according to claim 3, wherein said changing means includes print buffers for the recording elements disposed symmetrically, which selectively store print data for applying the ink from corresponding recording elements to change the order of applications of the inks to at least one of the secondary color pixel areas arranged in each raster line.

5. The apparatus according to claim 4, wherein said forming means distributes the print data to the print buffers on the basis of an image signal corresponding to a color image to make the order of applications of the inks to at least one of the secondary color pixel areas arranged in each raster line different from the order of another.

6. The apparatus according to claim 5, wherein said forming means distributes the print data randomly to the print buffers on the basis of the image signal corresponding to the color image.

7. The apparatus according to claim 5, wherein said forming means distributes the print data alternately to the print buffers on the basis of the image signal corresponding to the color image.

8. The apparatus according to claim 3, wherein the recording elements comprise cyan, magenta and yellow ink recording elements, and one of such recording elements is at a center of the symmetry.

9. The apparatus according to claim 3, wherein a number of the sets is two.

10. The apparatus according to claim 8 or 9, wherein said recording head further includes a recording element for applying black ink.

11. The apparatus according to claim 1, wherein said recording head includes recording elements for applying different color inks arranged in the scanning direction, and said changing means changes the order of applications of the inks to the pixel areas by selecting a scanning direction of the recording head in which the ink is applied to the pixel areas.

12. The apparatus according to claim 1, further comprising a means for applying to the secondary color pixel area a plurality of at least one of the color inks to be applied to form the secondary color to make the order of applications of the inks of said one of the color inks symmetrical to that of the other color.

13. The apparatus according to claim 12, wherein a plurality of the other ink is applied to the pixel area.

14. The apparatus according to claim 13, wherein a plurality of the dots of the one color ink and a plurality of dots of the other color inks applied in a different order are provided in said pixel area.

15. The apparatus according to claim 12, wherein centers of gravity of the dots of the different colors applied to the pixel area are substantially aligned with each other.

16. The apparatus according to claim 12, wherein dots of inks of different colors applied to the pixel area are at least partly overlapped.

17. The apparatus according to claim 1, wherein said apparatus is incorporated in a copying machine having a scanner effecting the scan.

18. The apparatus according to claim 1, wherein said apparatus is incorporated in a facsimile machine having a data sending and receiving device.

19. A printing apparatus for forming a color image by application of different color inks onto a printing material while bi-directionally moving the recording head to scan the printing material, said recording head having one or more sets of recording elements arranged in a scanning direction symmetrically, said apparatus comprising:

print buffers, each of said print buffers corresponding to the symmetrically arranged recording elements constituting the set; and a distributing means for distributing print data for a color to at least one of said print buffers on the basis of an image signal corresponding to the color image, wherein said distributing means makes distribution of the print data corresponding to at least one of secondary color pixel areas arranged in a raster scan direction.

20. A printing apparatus for forming a color image by application of different color inks to a printing material using a recording head, while bi-directionally moving the recording head to scan the recording material, said apparatus comprising:

a record control means for effecting recording with control of ejection of the ink to each of pixel areas being constituted only by a primary color or colors or constituted by a secondary color or colors, said record control means effecting process color recording by application of a plurality of colors of inks to each of the pixel areas;

a changing means for changing an order of applications of inks of different colors to form a process color in a process color pixel area;

a forming means for forming the process color by making an order of applications of the inks to at least the secondary color pixel areas arranged in a raster scan direction different from the order of another, by said changing means.

21. The apparatus according to claim 1 or 20, wherein the recording head ejects the ink by heat.

22. A printing method for forming a color image by application of different color inks onto a printing material using a recording head, while bi-directionally moving the recording head to scan the printing material, said method comprising:

a recording step, of effecting recording while controlling applications of respective different color inks, wherein said recording step includes a plurality of different color inks being applied to secondary color pixel areas;

a first step of application of different color inks to form a secondary color in a secondary color pixel area in one order of applications; and a second step of application of different color inks to form the secondary color in the secondary color pixel area in an order of applications which is different from the order in said first step of application.

23. The method according to claim 22, wherein the recording head includes two sets of recording elements for application of the color ink, the recording elements constituting the set being arranged in the scanning direction symmetrically, and said first step and said second step are carried out through one scanning motion of the recording head.

24. A printing apparatus for forming a color image by applying different color inks to a printing material using a recording head, while bi-directionally moving the recording head to scan the recording material, said apparatus comprising:

a record control means for applying the ink to respective pixel areas, each of said pixel areas being constituted only by a primary color or colors or constituted only by a secondary color or colors, and for controlling ink application to each of said pixel areas in accordance with multi-level data;

a changing means for changing an order of applications of the inks to be applied for printing a secondary color to a secondary color pixel area; and a forming means for forming the secondary color while making the order of applications of inks to at least one of a plurality of the secondary color pixel areas arranged along a raster scan direction different from the order of another, by said changing means.

25. A printing apparatus for forming a color image by applying different color inks to a printed material using a recording head, while bi-directionally scanning the recording head to scan the recording material, said apparatus comprising:

changing means for changing an order of applications of the inks to be applied for printing a secondary color pixel area, wherein said changing means is capable of changing the order of applications of the inks for each pixel along a raster scan direction; and forming means for forming the secondary color while making the order of applications of the inks to at least one of a plurality of the secondary color pixel areas arranged along the raster scan direction different from the order of another, by said changing means.

26. A printing method for forming a color image by applying different color inks to a printed material using a recording head, while bi-directionally scanning the recording head to scan the recording material, said method comprising the steps of:

changing an order of applications of the inks to be applied for printing a secondary color pixel area, wherein said changing step includes selectively changing the order of applications of the inks for each pixel along a raster scan direction; and forming the secondary color while making the order of applications of the inks to at least one of a plurality of the secondary color pixel areas arranged along the raster scan direction different from the order of another, in said changing step.

27. An apparatus according to claim 19, wherein said distributing means distributes the print data to either one of the print buffers when the image signal has a low level, and distributes the print data to both of the print buffers when the image signal has a high level.

* * * * *

UNITED STATES PATENT AND TRADEMARK OFFICE

CERTIFICATE OF CORRECTION

PATENT NO. : 6,896,356 B1
DATED : May 24, 2005
INVENTOR(S) : Naoji Otsuka et al.

It is certified that error appears in the above-identified patent and that said Letters Patent is hereby corrected as shown below:

Title page,
Item [75], Inventors, "Chikuma, Kawaski (JP)" should read -- Chikuma, Kawasaki (JP) --.
Item [30], Foreign Application Priority Data, "11/278952" should read -- 11-278952 --.
Item [56], References Cited, FOREIGN PATENT DOCUMENTS,
"79-56847" should read -- 54-56847 --;
"84-138461" should read -- 59-138461 --; and
"85-71260" should read -- 60-71260 --.
Item [57], ABSTRACT,
Line 4, "cording" should read -- recording --.

Column 1,
Line 17, "operation" should read -- operation can be reduced --;
Line 39, "electing" should read -- ejecting --;
Line 57, "in ink" should read -- ink --; and
Line 64, "the use is made with" should read -- use is made of --.

Column 2,
Line 15, "use independent two" should read -- using two independent --;
Line 19, "bands" should read -- bands is --;
Line 33, "print" should read -- printed --;
Line 34, "provide" should read -- provides --; and
Line 52, "print data." should read -- print data can be reduced. --.

Column 3,
Line 20, "formation" should read -- form --.

Column 4,
Line 10, "patter" should read -- pattern --;
Line 53, "of" should be deleted; and
Line 56, "caused" should read -- been caused --.

Column 6,
Line 39, "controlled" should read -- controlled. --; and
Line 65, "a" should read -- of a --.

Column 7,
Line 8, "Figure," should read -- Figures, --; and
Line 26, "and a" should read -- and --.

UNITED STATES PATENT AND TRADEMARK OFFICE

CERTIFICATE OF CORRECTION

PATENT NO. : 6,896,356 B1
DATED : May 24, 2005
INVENTOR(S) : Naoji Otsuka et al.

It is certified that error appears in the above-identified patent and that said Letters Patent is hereby corrected as shown below:

Column 9,
Line 20, “are” should be deleted;
Line 27, “C2” should read -- C2 in the forward path --;
Line 39, “and the” should be deleted;
Line 48, “such that” should read -- as follows: the --;
Line 54, “path,” should read -- path, the order is as follows: --; and
Line 66, “he” should be deleted.

Column 10,
Line 1, “write” should read -- writes --;
Line 16, “205Cl.” should read -- 205Cl, --;
Line 24, “for” should read -- are provided for --; and
Line 57, “nozzle” should read -- nozzles --.

Column 11,
Line 18, “relationship” should read -- relationship is shown --; and
Line 51, “stripes,” should read -- stripes be reduced, --.

Column 12,
Line 17, “pair” should read -- a pair --;
Line 23, “The printing the defective” should read -- Printing is defective --;
Line 45, “they use is made with” should read -- use is made of --;
Line 60, “rasters.” should read -- raster. --; and
Line 62, “form” should read -- from --.

Column 13,
Line 1, “In the present invention, it” should read -- It --;
Line 12, “in the use is made with” should read -- wherein use is made of --;
Line 40, “occurs” should read -- occur --;
Line 55, “is” should read -- are --;
Line 56, “has” should read -- have --; and
Line 57, “applied” should read -- applies --.

Column 14,
Line 23, “the raster one” should read -- one raster --;
Line 64, “the” should read -- the fact that the --; and
Line 67, “scamming” should read -- scanning --.

UNITED STATES PATENT AND TRADEMARK OFFICE

CERTIFICATE OF CORRECTION

PATENT NO. : 6,896,356 B1
DATED : May 24, 2005
INVENTOR(S) : Naoji Otsuka et al.

It is certified that error appears in the above-identified patent and that said Letters Patent is hereby corrected as shown below:

Column 15,
Line 1, “so” should read -- has the result --;
Line 11, “interraced” should read -- interlaced --;
Line 50, “simple” should read -- simplify --;
Line 62, “show” should read -- shows --; and
Line 67, “make” should read -- ensure that --.

Column 16,
Line 10, “caused” should read -- been caused --.

Column 17,
Line 45, “the” should read -- with the --.

Column 19,
Line 13, “the other ink” should read -- other color inks --.

Signed and Sealed this

Thirteenth Day of December, 2005

JON W. DUDAS
*Director of the United States Patent and Trademark Office*